US007102111B2

(12) United States Patent
Metcalf et al.

(10) Patent No.: US 7,102,111 B2
(45) Date of Patent: Sep. 5, 2006

(54) MULTI-PURPOSE FOOD-SERVING APPARATUS

(76) Inventors: Darrell J. Metcalf, 905 N. Oak Ave., Fillmore, CA (US) 93015; Michael Goodrow, 229 Beach St., Santa Monica, CA (US) 90405

( * ) Notice: Subject to any disclaimer, the term of this patent is extended or adjusted under 35 U.S.C. 154(b) by 0 days.

(21) Appl. No.: 10/223,741

(22) Filed: Aug. 20, 2002

(65) Prior Publication Data

US 2004/0035863 A1 Feb. 26, 2004

(51) Int. Cl.
*H05B 6/80* (2006.01)

(52) U.S. Cl. ..... 219/734; 219/725; 426/112

(58) Field of Classification Search ..... 219/734, 219/725; 206/551, 565, 525; 229/45, 116, 229/906, 902, 108, 103, 938, 243, 406; 426/112, 426/115, 122, 128, 129, 123, 126, 394; 428/34.1, 428/43; 220/212
See application file for complete search history.

(56) References Cited

U.S. PATENT DOCUMENTS 239,413 A * 3/1881 Wilson ..... 229/122
2,298,146 A * 10/1942 Mersbach ..... 229/115
4,189,054 A * 2/1980 Liu et al. ..... 220/4.23
4,933,525 A * 6/1990 St. Phillips ..... 219/725
D317,721 S * 6/1991 Fiorillo et al. ..... D9/430
5,181,649 A * 1/1993 Frost ..... 229/125.125
5,213,858 A * 5/1993 Tanner et al. ..... 428/34.2
6,299,918 B1 * 10/2001 Morgese ..... 426/112
6,681,983 B1 * 1/2004 Bill-Moore ..... 229/162.3
2003/0029868 A1 * 2/2003 Davidov et al. ..... 220/212
2003/0121961 A1 * 7/2003 Pilgrim et al. ..... 229/101.2

* cited by examiner

*Primary Examiner*—Quang Van

(57) ABSTRACT

A folds-as-you-eat multi-purpose food-serving apparatus ('MPFSA') that is supportable from one end by one hand during eating, and has optional exhibiting means for providing multi-minute close-proximity exposures promoting observer-discernible content and/or user-discernible content, and optionally providing recreational, or display, functionality. The MPFSA is comprised of one or more materials having a pliability which accommodates the bending and unbending of the apparatus a plurality of times in a manner that will not significantly alter the presentation of served food. The MPFSA is also comprised of material(s) having sufficient rigidity to support one or more items of food, having a food-supporting surface which is stiffened by at least one adjacent food-retaining portion which extends upward from an edge thereof, or can be so positioned by a user, to increase the rigidity of, and facilitate the retention of served food on, the apparatus. The food-supporting surface of the apparatus is predisposed to be selectively bent and unbent, by a user, adjacent to an end of a reduced cross-section of at least one food-retaining portion. The food retaining portion(s) has at least one reduced cross-section predisposed to be bent and unbent by a user adjacent to the food-supporting surface reduced cross-section(s). Upper surfaces of the MPFSA provide close proximity viewing as a user is taking, or about to take, a bite out of the served food. MPFSA surfaces are easily viewed by observers proximate to the user, when the user is holding the apparatus or when it is in a resting position.

4 Claims, 22 Drawing Sheets

10
20
14
54
14
216
214
216
54
24

54
216
218
214
218
218
10
24

54
26
16
26
16
26
16
26
16
10
24

54
24
16
38
20
26
12
20
26
38
20
122
26
38
20
216
216
218
214
218
218
16
20
16
14
20
48
46
16
42
44
36
20
16
20
10

MULTI-PURPOSE FOOD-SERVING APPARATUS

CROSS-REFERENCE TO RELATED APPLICATION

This is a non-provisional patent application, which is related to provisional patent application 60/289,730 filed May 10, 2001, and its respective non-provisional application Ser. No. 10/144,301 filed on May 13, 2002, and relies substantially on provisional patent application 60/312,987 filed Aug. 17, 2001.

FIELD OF THE INVENTION

The present invention pertains to the field of food serving apparatus and more particularly to a folds-as-you-eat food serving apparatus preferably formed of a single contiguous material having sufficient rigidity and shape to provide alignment of, and support of, one or more items of food, and having one or more apparatus segment portions that can be selectively folded away from the supported food item(s) in a manner not requiring the folding, or altering of the normal appearance or normal presentation, of the food item(s), and that can be done so, during the eating of the food to improve the eating experience. An arrangement of one or more reduced-cross-sections and one or more bendable cross-sections in the apparatus provides for repeated bending and unbending of the apparatus, as needed, such that a user may bend one or more tray segments away from food supported by the plate as a user eats the food, and subsequently easily bends the plate back to its original shape, for example, to set the plate down. In one embodiment, the apparatus can be selectively bent or formed by a user, during the process of eating served food, to significantly improve the eating process and experience, and in another embodiment, can also be selectively bent or formed by a user for one or more exhibition and/or recreational purposes. The apparatus provide an exhibiting means whereby observer-discernable content, can be easily seen by one or more persons proximate to the apparatus, and an exhibiting means whereby user-discernable content is brought into a user's field of view as a user is about to eat and/or is eating one or more items of food supported on the apparatus. Embodiments of the invention also include methods: for improving the customer experience; customer service; food-serving apparatus advertising and ad-use verification; for substantially increasing the profit margins typically attributed to food-serving apparatus particularly when made of a paper or plastic material; and for improving food-serving apparatus one-hand ease-of-use.

BACKGROUND OF THE INVENTION

In the food service industry, including restaurants, cafeterias, cafes, pizzerias, convenience stores, 'Drive Thru', 'Take-Out', or 'Quick-Stop' markets, and the like, it is customary to provide customers with certain food-items served on some kind of plate or tray. Typically, such plates or trays are made out of a paper or plastic material that is preferably rigid enough to support the item(s) of food being served. With certain types of foods it would be advantageous to have plates or trays that, in addition to being rigid enough to support the weight of served food, could also be selectively bent by the customer to improve the ease of eating the served food. To some degree, efforts along these lines have been attempted, but the results have been unsatisfactory.

For the purpose of describing the present invention, the food serving apparatus will be illustrated as a pizza slice plate or tray, however it is to be noted that the utility of the proposed invention is applicable to numerous types of foods, each of which, can be served on trays or plates having similar features and functionality.

Conventionally, a slice of pizza is typically served on a disposable plate or tray. During the eating of the pizza, it is picked up and returned to the same plate, a number of times. If the food is too hot, a customer can easily burn his or her mouth on the food, or the hot pizza ingredients can easily slide off of the pizza slice. Additionally, the repeated handling of such foods can quickly make one's hands or fingers very greasy. If there is an abundance of cheese, sauce, or other ingredients, the pizza can bend from its own weight and tend to come apart, making the eating process a much messier one than is necessary. Many establishments serving pizza provide customers with a stack of napkins to compensate for such problems.

To address such concerns, several food-serving products have been tried. For example, pizza slice-shaped plates and trays have been used. One approach has provided a type of flat pizza tray which is sized approximately to the length, width and shape of a pizza slice intended to be served on the tray. The planar tray is made out of a corrugated cardboard having corrugated flutes that run perpendicular to the length of a pizza slice resting on the tray. At various points along the length of the tray, a reduced cross-section, or score, aligned with the flutes, is formed into the tray to allow the customer to bend a tray in segments. Beginning nearest to the tip of the pizza, the customer bends each segment downward and away from the pizza slice as the pizza is being eaten. While the bending aspect of this approach offers a folding feature, the planar-tray approach has several shortcomings. First, several types of pizza are heavy for their size and the weight of such pizza can easily cause the tray to inadvertently collapse along its length which, either spills the pizza from the tray, or causes pizza ingredients to spill off of the pizza slice. To counter the lack of sufficient rigidity, trays can be made thicker, but the added material (e.g. thicker paper, plastic or corrugated material) adds to the cost of the tray. Another problem with the flat tray approach is that the trays, in order to minimize the amount of paper used, are typically so closely sized to a pizza slice being served on them that it is quite easy for the pizza slice to become misaligned on the flat tray and when the tray is set down. When misalignment occurs, the pizza slice can easily contact surfaces, such as public surfaces, that are unsanitary. Such trays can also be set down on furniture, for example in a customer's home, or on a car seat, and the misaligned pizza can contact such surfaces causing unnecessary stains, or messes. These types of trays, once bent, do not readily regain an unbent, or previously supportive condition, and are therefore not suitable for re-use, for example, in serving a second or third slice of pizza. Also, the planar pizza slice tray approach does not lend itself to a convenient self-containment of pizza slices, for example to fold into the shape of a box suitable for transporting a pizza slice from a pizzeria to another location.

Some food serving trays and plates being offered, have a flat food-supporting member and one or more side rails that extend upward relative to a food-supporting member. Although the design of such trays and plates are effective in keeping one or more food item from sliding off, or from becoming misaligned, none of them offer the means to bend the trays or plates, or segments thereof, away from the served food while eating, unless they substantially alter the appearance and presentation of the served food (for example, folding the food in half on itself). With the latter exception, such trays and plates don't provide a way to maintain tray or plate rigidity until such time when a bending of the food-serving apparatus is desired; or to provide a way to unbend such plates after they've been bent, in a way that returns them to, or near to, their original food-supporting condition; or, cannot readily regain an unbent shape to accommodate re-use of the tray or plate for second or subsequent servings. In other words, once such trays or plates are bent by a user, they either significantly and irreversibly alter the appearance of the food (collapsing it upon itself), or lose their original rigidity and thus the ability to support the served food properly thereafter.

More typically, a slice of pizza is served on a plate that is not optimized for the size and shape, or weight of the pizza, or plates that are too thin tend to collapse under the weight and size of the pizza, and many napkins are used along with such plate as a user tries to control the pizza slice and eat the pizza in a two-handed operation. In such cases, much more paper will be used than is necessary. Similarly, more paper use is required when plates that are too flimsy need to be stacked on one another to provide enough rigidity to support the food being served.

None of the status quo approaches offer the means to selectively bend the trays or plates, or segments thereof, away from the served food while eating in a manner that preserves the presentation of the served food and maintains tray or plate rigidity until such time when a bending of the food-serving apparatus is desired. Such plates or trays still require a user to lift the pizza out of the food serving apparatus a number of times in order to eat the food.

A apparatus similar in appearance to the present invention is comprised of a plurality of materials and requires a user to physically collapse the pizza upon itself, along its length, such that the pizza is fully enclosed within the food serving apparatus and the pizza is revealed as segments of the plate are torn away from the encased folded food, to expose portions thereof that can be bitten. This approach completely alters the normal appearance and presentation of the food and leaves the user, when the slice of pizza has been consumed, with a plate that has literally been torn to pieces, making cleanup more difficult and forfeiting any convenient option to re-use the plate. The numerous plate pieces are quite likely to be coated with pizza sauce and/or other pizza ingredients and each will need to be picked up by the user in order to not pose a litter problem. If the user eats several slices of pizza, then the problems of the remaining plate pieces multiplies.

Consequently, there is a need for improved food-serving apparatus that address the shortcomings of the status quo, that provide a means to eat certain foods: with a one-handed ease of use; with a portability or transportability, or drive-as-you-eat convenience; similar to that offered with hamburgers, hot dogs, sandwiches, tacos, and the like.

Furthermore, food-serving apparatus to date, have not proved optimal in their application as, or conversion into, one or more types of recreational apparatus, or one or more types of exhibiting or display means. Typically such paper or plastic goods are simply thrown away. Food-serving goods that do have printed content or indicia, are not placed on the goods in a manner where they are easily read or discerned as a user is eating, or about to eat, a food item. While the lid of a beverage can or cup may have some type of user readable or discernable content, there are other limitations to the type of exposure that can occur with a beverage serving apparatus. Firstly, a beverage is typically imbibed very intermittently and for very short periods at a time. Secondly, the brief exposure to a lid or can top can be so close to one's eyes that it is often, or can easily be, completely out of focus.

Coffee cup sleeves have become a popular advertising food-service medium, nonetheless, their ad content is not in a user's field of view when the user is drinking, and only a fraction of the sleeve's circumference is viewable to the user at any given time, including limited portions thereof that in themselves, may not make any sense to the user. By contrast, the present invention, offers an improved food-service advertising medium offering increased discernible-content exposure times relative to those offered by;

a.) status quo food-serving apparatus, b.) status quo beverage-serving apparatus, and c.) advertising sleeves which slideably fit on beverage-serving apparatus such as sleeves for beverage cans and cups or coffee cups.

In the latter two cases ("b" and "c"), increases in discernible-content exposure times; increases in sustained, close-proximity exposure times; and, increases in content exposure times during hand-to-mouth movements; are achieved by MPFSA relative to beverage-serving apparatus and the advertising sleeves, and unlike the needs pertaining to sleeve ad-use accounting, the MPFSA has no requirement for a substantial number of personnel needed to constantly travel among thousands of food-service venues to verify and ensure that the paid-for ads on the sleeves are actually being used, i.e. slid onto the cups serving beverages. It is noted herein, that the discernible-content of the MPFSA is an integral part of the apparatus and therefore requires no ensuring or verification of use (a food-service apparatus supplier simply verifies that the number of MPFSA ordered and/or shipped for a given time and given venue, or chain of venues, is proportionate to a number units typically needed for such a period and number of venues). It is also noted that during the process of eating one or more MPFSA-served food-items, much of the discernible content appearing on a MPFSA can easily remain in the field of view of the user, and can be inclusive enough in content and context to have coherence and make sense to the user. In contrast, a coffee sleeve rarely has a message that is completely coherent from all surrounding viewpoints.

In contrast to "status quo food-serving apparatus" ("a" above), the present invention, offers a means for food-service apparatus/paper suppliers to substantially increase, what has historically been low, commodity types of profit margins for food-service paper goods and the like, by supplementing food-serving apparatus sales with significant advertising revenues.

By contrast, eating one or more items of food is a much slower process than drinking, especially if the food is fairly lightweight and can easily be held by one of the user's hands, and therefore an opportunity to offer a new type of food-serving apparatus having optional exhibiting means on one or more visible surface of the apparatus is practicable for displaying user readable or user-discernable content thereon which is easily seen before, during and after the user eats the served food. For example, one slice of pizza, depending on the size, takes approximately five to ten minutes to eat. If the user has a comfortable, light-weight, compact apparatus to support the pizza slice, it is very likely that the apparatus will be held in close proximity to the user's field of view during much of the time needed to eat the slice. Furthermore, such sustained exposure(s) to the content(s) can be amplified when a user eats food which uncovers more viewable content(s) on the apparatus food-supporting surface and/or bends segments of that surface in a manner that such content, or content on the bottom of such segments, become easily viewed by those in close proximity to the user.

Thus there is a need for improved food-serving apparatus that address the deficiencies of the status quo. The purpose of the present invention is to provide improved food-serving apparatus which eliminate the shortcomings detailed above and that offer a number of distinct advantages. Therefore several objects of the present invention can be put into practice, which will provide:

a view-as-you-eat and/or folds-as-you-eat multi-purpose food-serving apparatus ('MPFSA') that provides a cleaner way of eating food, more specifically, one not requiring a user to pick up one or more food-items from a plate or tray during an eating process, or requiring the user to arrange and/or re-arrange the food-item(s) with his or her fingers during the eating process. Thus a primary of object of the invention is to provide a food-serving apparatus that minimizes, or eliminates, the contacting of a user's fingers with food-item(s), particularly food items such as a pizza slice which normally requires numerous cycles of lifting and setting down the pizza in a plate or tray during the process of eating one or more slices of pizza, which can be very hazardous if one is attempting to do this while driving a vehicle.

MPFSA that provide a similar one-handed ease-of-handling, method of eating, portability, transportability and drive-as-you-eat convenience usually associated with foods such as hamburgers, hot dogs, sandwiches, tacos, and the like; to served food-items which historically have not been associated with such advantages, and typically require two-handed eating, such as pizza slices and an assortment of other food-items described in this specification.

MPFSA that provide a means for paper suppliers to substantially increase what has historically been commodity types of margins by combining or supplementing food-serving apparatus sales with advertising revenues.

MPFSA that are employable as, or convertible into, one or more type of: recreational apparatus; toy; exhibiting means; or display means.

MPFSA that increase food sanitation particularly in public places.

MPFSA that improve the customer experience and customer service of those using food-serving apparatus.

MPFSA that reduce the likelihood of stains.

MPFSA providing an improved food-service advertising medium providing increases in sustained discernible-content exposure time and a closer proximity to such exposures, relative to status quo food-serving apparatus, beverage-serving apparatus, and beverage cup or can sleeve advertising media. And in the latter case, no requirement of substantial personnel to constantly travel among thousands of food-service venues in order to ensure that paid ads on the sleeves are actually being slid onto cups.

MPFSA that are employable as, or convertible into, one or more type of recreational apparatus and indicia/viewable content exhibiting means.

MPFSA that provides a one-handed eating, portability, or transportability, or drive-as-you-eat, experience and convenience similar to that of a sandwich, or hamburger, or hot dog, or taco, and the like, and formerly not available to food-items generally eaten with two hands such as a pizza slice, and making practicable the serving of food-items of the latter type to motorists from take-out, or 'Drive-Thru', windows, or from other establishments such as convenience stores, gas station markets, 'Quick-Stop' stores, and the like, designed to serve the needs of motorists on the go.

MPFSA providing improved food-serving apparatus shaping to facilitate rapid shaping of MPFSA as needed to quickly set them down in an unbent condition, or quickly resume an eating process by returning the apparatus to a former bent condition. An apparatus rigidity and selective pliability provides for repeated bendings and for returning the apparatus to a near original unbent condition by recreasing the apparatus such that at least one food-retaining portion(s) is substantially returned to its original upward extending position.

multi-purpose serving trays or plates having sufficient rigidity to serve and support food items such as pizza and the like, such that a user can readily hold the apparatus in one hand while eating or in between bites, and/or while holding a drink, or napkin, or phone, or other object in the other hand, including doing so while seated, driving a vehicle, or while walking.

multi-purpose serving trays or plates having sufficient rigidity to serve and support one or more items of food until a time when a user can selectively bend one or more segment(s) of a food-serving apparatus away from the served food to facilitate the eating of the food and an apparatus that conveniently and easily regains its shape when placed in a resting position on a flat surface, and can regain its original serving shape with sufficient rigidity to support the served food or subsequent serving of additional food item(s).

multi-purpose serving trays or plates having sufficient rigidity to serve and support one or more items of food until a user selectively bends the combination of one or more tray or plate bendable cross-sections and one or more tray or plate foldable joints to bend segment(s) of a food-serving apparatus away from the served food to facilitate the eating of the food.

multi-purpose serving trays or plates having sufficient rigidity to serve as a self-standing display or self-supporting display.

multi-purpose food-serving trays or plates offering improved protection from unsanitary public or domestic surfaces when the trays or plates are set down on such surfaces.

multi-purpose food-serving trays or plates that can be easily boxed, or enclosed within a lid and subsequently used, when the lid is opened or separated, as a tray or plate.

multi-purpose economical food serving apparatus having a price similar to other apparatus designed to serve the same food but requiring substantially less material due to the shaping of the tray to the shape of the food item expected, or designed, to be served thereon.

multi-purpose economical food serving apparatus having a locking lid, or clamshell configuration wherein one or more napkins are also included with the apparatus package, or wherein a multi-purpose food-serving apparatus is easily stacked for food-service operations.

These and other objects will be elaborated upon in the detailed descriptions below.

PRIOR ART

Search of U.S. and foreign patents has not revealed a multi-purpose view-as-you-eat and/or folds-as-you-eat food serving apparatus having one or more user-selectable bendable cross-sections extending across a width of a food-supporting member of the apparatus, that is supported by at least one adjacent food-retaining portion extending perpendicularly therefrom, in a manner which, increases the rigidity of the apparatus and prevents the bending of a bendable cross-section(s) until a user:

selectively bends one or more bendable or foldable joints which is predisposed to fold at, and is located tangent to, at least one end of the bendable cross-section(s) to bend a segment(s) of a food-serving apparatus away from the served food to facilitate the eating of the food.

Nor have the searches revealed a multi-purpose food-serving apparatus that is employable as, or convertible into, one or more type of recreational apparatus, or multi-purpose food-serving apparatus having user-discernable and/or observer-discernable content, wherein the apparatus is employable as, or convertible into, one or more types of wearable items, or convertible into one or more exhibiting means providing indicia or other viewable content that can be viewed by a user for several minutes during the eating of one or more served food items.

European patent WO-09700040 shows a flat food serving tray having a number of scores to allow the tray to be bent, however no method is provided to return a once-bent plate of this type back to its original food supporting condition. Furthermore, it was observed that when the trays were used by customers in Europe, they were often set down on unsanitary public surfaces and there was insufficient means for keeping pizza from becoming easily misaligned on the trays. If this type of tray was employed in one's home, such misalignment could be the cause of unwanted furniture stains and other messes, particularly when used by children. Adjacent side panels were not added to the side edges of the tray to align the pizza, because the panels, and length thereof, would prevent the bending advantage of the thick tray. Consequently, the WO-09700040 patent is not able to sufficiently align and support, a slice of pizza in a manner that would be considered sanitary.

U.S. patents U.S. Pat. No. 5,476,214 and U.S. Pat. No. 5,129,521 respectively, show pizza serving trays that are nearly the same size as pizza that is meant to be served on the trays, and consequently would suffer from the food misalignment disadvantages cited above. The inventions also have little or no means to assist in the alignment of food served thereon.

U.S. Pat. No. 6,299,918 describes a pizza tray specifically, that collapses, or folds, the pizza within a food serving apparatus having a lengthwise crease which predisposes the device to bend along its length so that it can encase the folded pizza internally within the apparatus. Obviously, this approach requires the user to significantly alter the original shape and appearance of the served pizza before eating it. The pizza tray has a plurality of parts whereby the lengthwise crease is separated by use of a pull string or perforation and tin strips embedded in the plate. The Morgese patent describes a fold over flap that is intended to allow the user to pinch the crust of the pizza beneath the flap, but it is noted that the operation of this flap is not illustrated or adequately described in the invention, i.e., how would one first fold a pizza slice lengthwise on itself, encased within the lengthwise folded plate, and then still have a flap available either: to pinch the pizza's crust, or to be visible to a user? Logically, it would seem that the flap would have to be folded over on itself if the rest of the folding plate does the same. Once the flap is folded on itself, or within the lengthwise folded plate, its usefulness as a viewable surface for any indicia is substantially reduced if not completely nullified. It is also noted that the idea of such a flap is taught in prior art predating the filing date of Morgese's patent, for example, U.S. Pat. No. 5,129,521 issued Jul. 14, 1992. Similarly, the Morgese patent describes indicia being included on his device, however, the only indicia that would be viewable after the plate has been folded on itself would be the bottom of the plate which the inventor describes as being torn off as the pizza is consumed. Such an approach would limit the exposure of the indicia to no more than half the folded plate being seen at one time, and less than that after the plate is torn in pieces. Furthermore, the printing of indicia, including promotional subject matter on food serving plates has been practiced for decades and is widely known. Again, U.S. Pat. No. 5,129,521, was commercialized with trays having indicia printed thereon. It is also noted that there are numerous types of popular foods that would not lend themselves to being folded along their length, and it is therefore questionable as to whether a user would find it desirable to collapse their food in such a manner, in which case, the intended functionality offered by the Morgese patent would not be desirable. By contrast the present invention does not require its served food to be altered in shape or appearance, nor does its fold-as-you-eat operation obscure the viewability of indicia or other viewable content. Instead, unlike any prior art investigated, it promotes the viewing of indicia or viewable content in virtually any static, transient, resting, held, eating, non-eating, bent or unbent condition.

None of the cited prior art provides for a view-as-you-eat and/or folds-as-you-eat multi-purpose food-serving apparatus ('MPFSA') for accomplishing the objects of the present invention. Consequently, the European and U.S. patents are deficient in structure and operation, and an improved food serving apparatus is needed.

SUMMARY OF THE INVENTION

In the food service industry, including restaurants, cafeterias, cafes, pizzerias, and the like, and public venues such as amusement parks, ball parks, stadiums, arenas, race tracks, or air shows, it is customary to provide customers with food served on some kind of plate or tray. Typically, such plates or trays are made out of a disposable paper or plastic material and used for the sole purpose of serving food. The multi-purpose food-serving apparatus 'MPFSA' of the present invention is comprised of a plate or tray that is rigid enough to support the weight of served food and that also can be bent or formed by a user to more easily eat served food. The plates or trays optionally provide recreational and/or advertising, or marketing, or promotional, or cross-promotional, functionality and can also be made into self-standing displays comprised of one or more plates or trays. For example, a plate or tray of the present invention can easily be converted into a recreational apparatus, such as: a flyable airplane, or become part of a kite, or be converted into a pennant, or a flag, or a visor, for use at an arena or sporting event, or is convertible into a sail for a toy sailboat or a land-sailing toy, and so forth. Additionally, the MPFSA provides exhibiting means having one or more surfaces with user-discernable and/or observer-discernable content appearing thereon, that are clearly visible when a user is about to eat, and is eating an item of food served thereon, and can also be seen when the apparatus is placed in a resting position. One or both sides of one or more positionable segments of the apparatus can also include the discernable content(s). The MPFSA can be formed or otherwise shaped, or are subsequently formable by a user, with such surface(s) including, but not limited to, any one or more of the following types of indicia or printed matter: text, right-reading text, pictorial content, graphical content, advertising content, menu contents, logos, corporate logos, film titles, book titles, brand names, marketing and/or cross-promotional content, removable discount coupon(s), prize announcements, and the like. Depending on which surfaces have the aforementioned content(s), the surface(s) is viewable by a user when the user is eating food resting on the apparatus; or the surface(s) is viewable by a user as food is eaten or otherwise removed from a food-supporting surface of the apparatus; and/or is viewable by the user and those in the vicinity of the user after the food has been consumed. The surface(s) can be made of a paper or cardboard-derived material, or can be formed out of a plastic material that is opaque, or translucent, or transparent, or a material that is oven or microwave capable, or any combination thereof. The material optionally can be formed or shaped employing any one or more of a variety of manufacturing methods or steps including, but not limited to, embossing, die-cutting, scoring, perforating, cutting, bending, forming, vacuum-forming, or plastic injection molding, and the like.

In a preferred embodiment, one or more of the surfaces of the MPFSA has a plurality of functions. For example, a triangular-shaped plate or tray can be sized and shaped during its manufacture to receive and support a large slice of pizza such that a rear portion of the plate is made to bend and extend upward tangent to a rear edge of a food-supporting surface to form a rear panel next to where the crust of a slice of pizza is located. Tangent to an upper edge of the rear panel, a food-retaining tab is made to bend and extend forward over the top of a pizza slice crust. The rear panel and food-retaining tab have an interior-facing surface that contacts the pizza crust when a user holds the tab and the food-supporting surface of the food serving apparatus between two or more digits of his or her hand(s). The rear panel and food-retaining tab also have an exterior-facing surface on either or both of which, printed, shaped, formed and/or die-cut matter can be displayed. For example, printed and/or die-cut matter can be located on the upper or exterior-facing surface of the food-retaining tab such that when a user points an end of the tray having the tip of a slice of pizza on it towards his or her mouth, the printed and/or die-cut matter on the tab is viewable as each bite of the pizza is taken. The MPFSA can have any one or more of a variety of printed, embossed, die-cut or otherwise shaped surfaces wherein one or more of the surfaces have engaging, or entertaining, or pictorial, or advertising, or marketing, or promotional, or cross promotional content, or any combination thereof. In one embodiment, the MPFSA has a scored and/or printed surface which facilitates a configuring of one or more apparatus, by a user, into one of a variety of recreational apparatus such as flying airplanes, sailing toys, kites, visor, pennant or flag and the like. One or more of the apparatus can also be used as the sail of a sailing toy.

In each case, a user may simply use the apparatus as a bendable, or otherwise formable, food serving plate, or tray, that has user-discernable content on one or more surface areas that is easily viewed by the user while eating food supported by the apparatus, and/or is revealed to the user as food, covering the surface area, is consumed or otherwise removed from the food-supported surface. In another embodiment the apparatus is stackable with a lid to expedite diverse food-service operations including an incorporation of MPFSA, and their one-handed operation feature (which makes eating foods like a pizza slice similar to the way a hamburger, hot dog, sandwich, burrito, and taco can be eaten i.e. mostly with one hand), at restaurants, cafeterias, cafes, pizzerias, convenience stores, featuring 'Drive Thru', and 'Take-Out' food to go.

Figure 5:
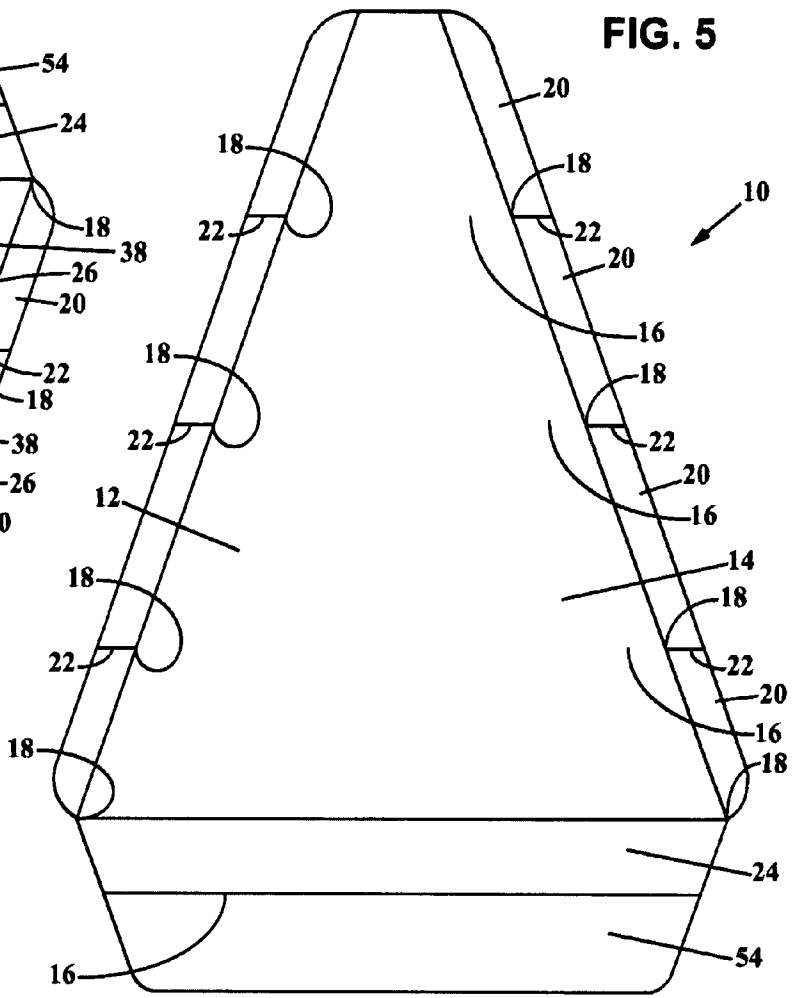
FIGS. 4 through 9 are top views of a variant of a multi-purpose food-serving apparatus before it is three-dimensionally shaped into a food-serving configuration wherein, a.) in FIG. 4 bendable cross-sections extend across a food-supporting member as printed fold lines, or as reduced cross-sections that are scored and/or perforated.
Figure 7:
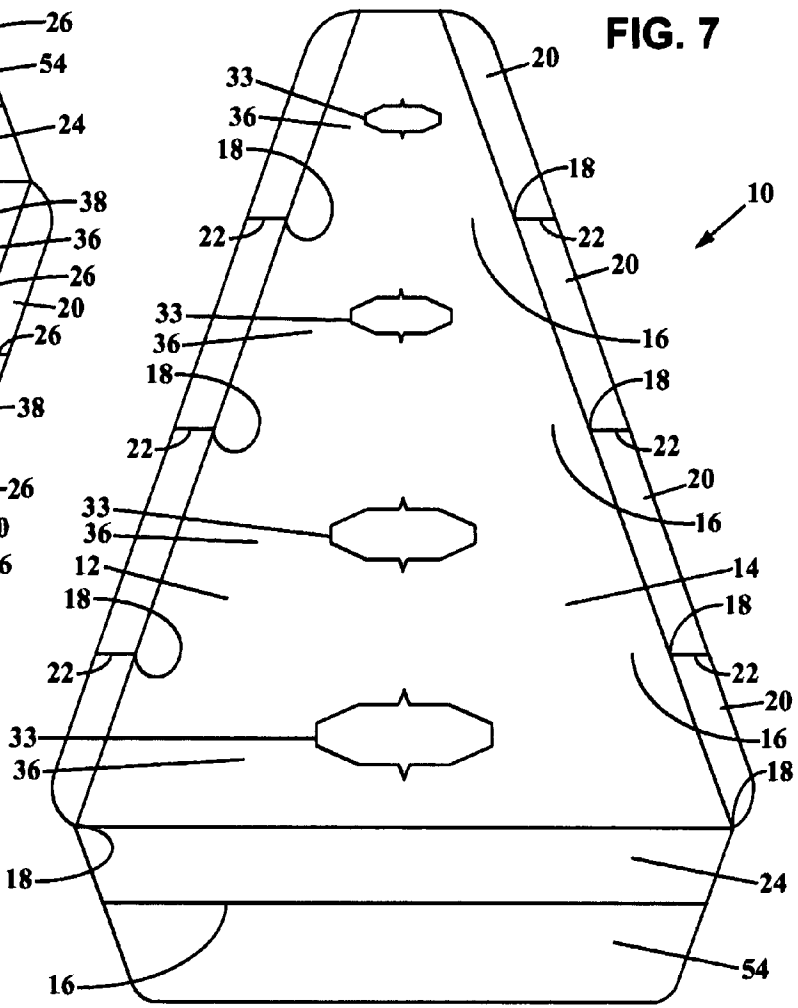
Figure 6:
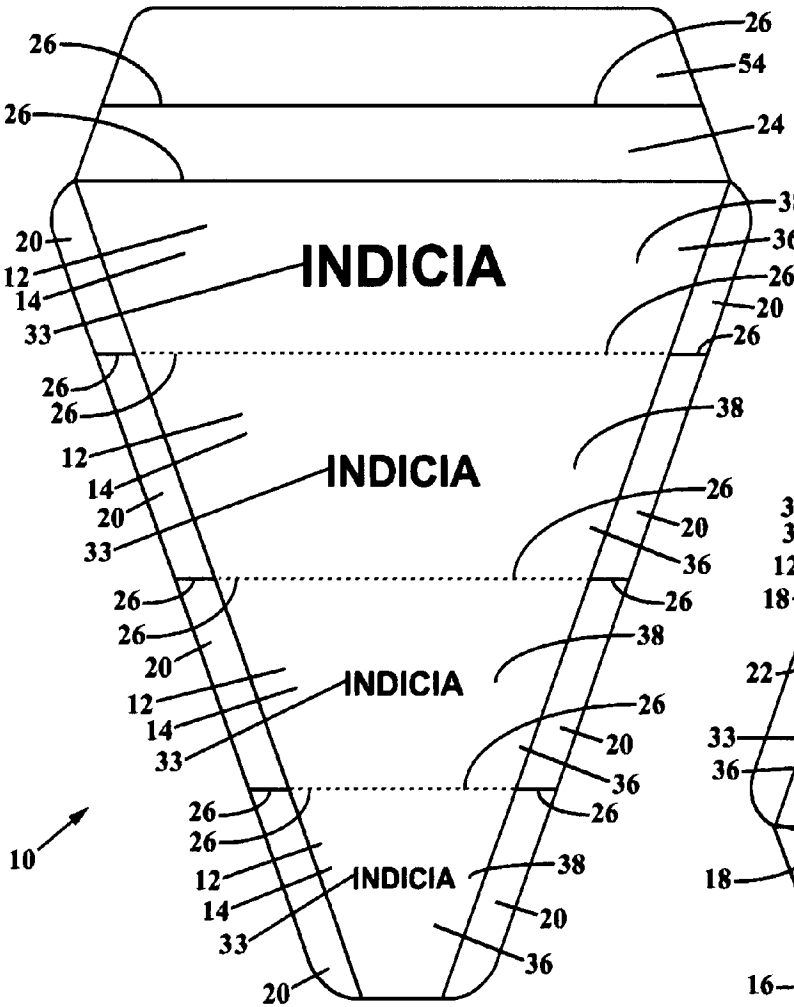
Figures 8, 9:
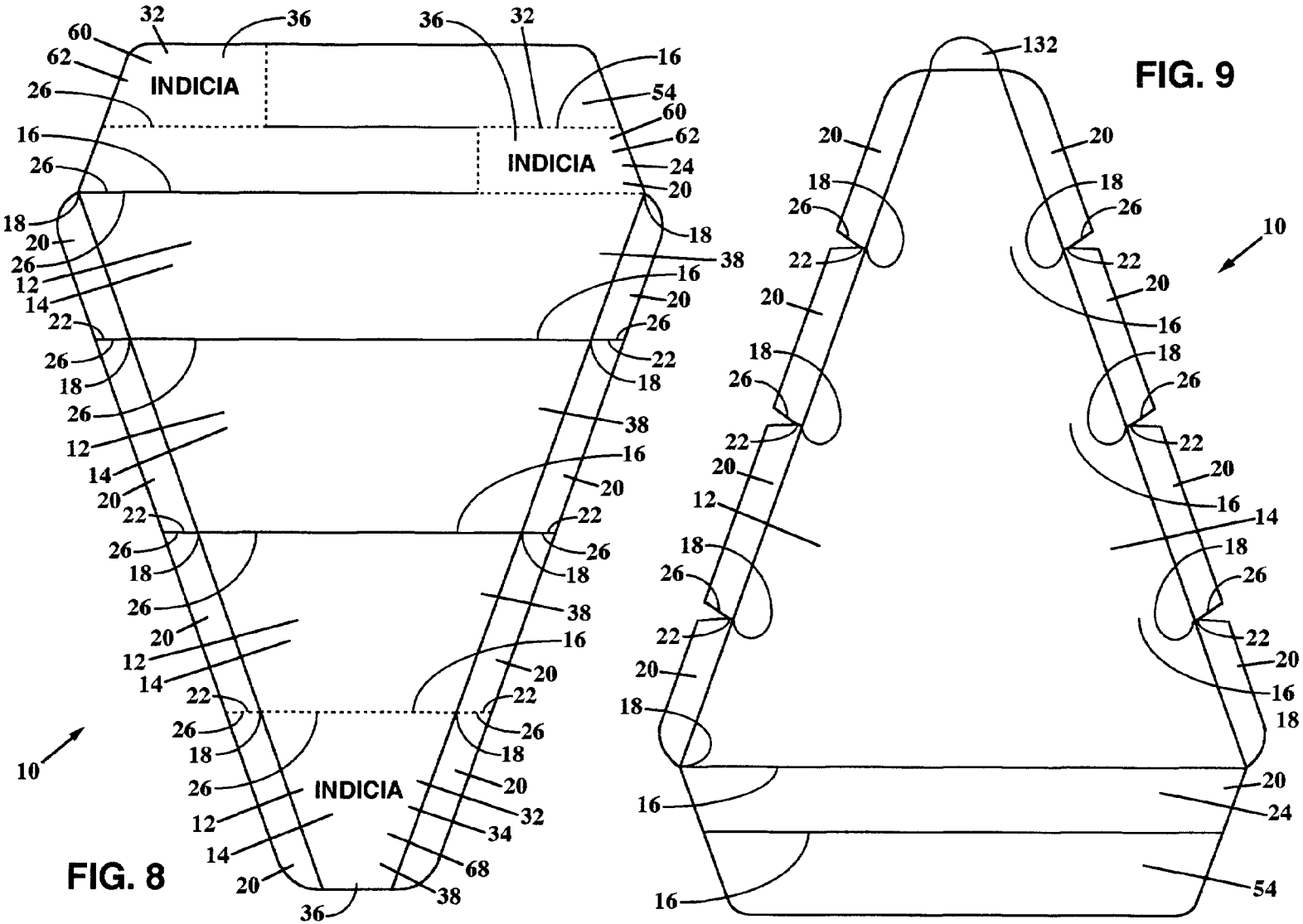

b.) in FIG. 5 the food-supporting member is not printed or predisposed to bend along a particular cross-section but can bend tangent to one or more food-retaining portion joints;

c.) in FIGS. 6 through 8 one or more surfaces of a variant of the apparatus exhibits any one or more of a variety of user-discernable and observer-discernable content and/or various-sized content, including, indicia, printed matter, Braille content, die-cut, embossed, content and the like, optionally including one or more of the following: corporate or organizational logos, coupons(s); prize announcement(s), and the like; and d.) in FIG. 9 reduced-cross-sections of the food-retaining portions are reduced in height rather than in thickness.

Figure 10:
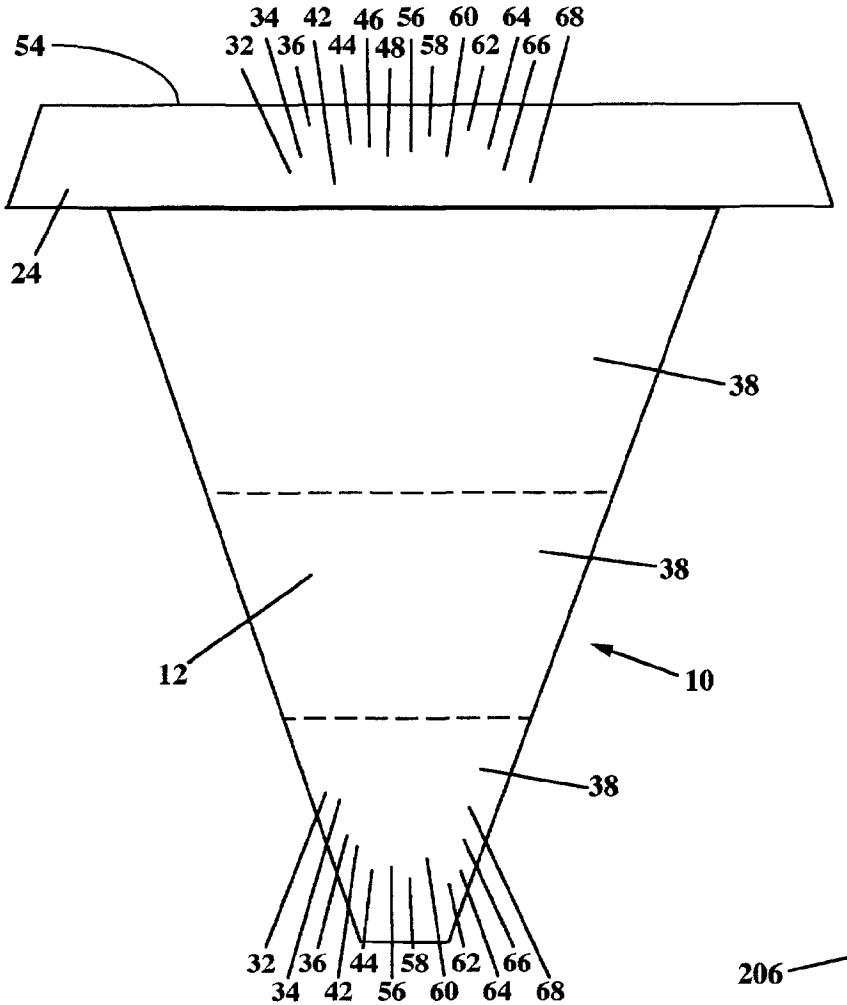

FIG. 10 is a rear view of a multi-purpose food-serving apparatus illustrating that a rear food-retaining portion and/or one or more lower surfaces of a positionable segment are employable as exhibiting means upon which user-discernable and/or observer-discernable content can be displayed, such as any one or more of the contents referred to above. The positionable segments are shown in a downward-pointing position relative to the rear panel.

Figure 11:
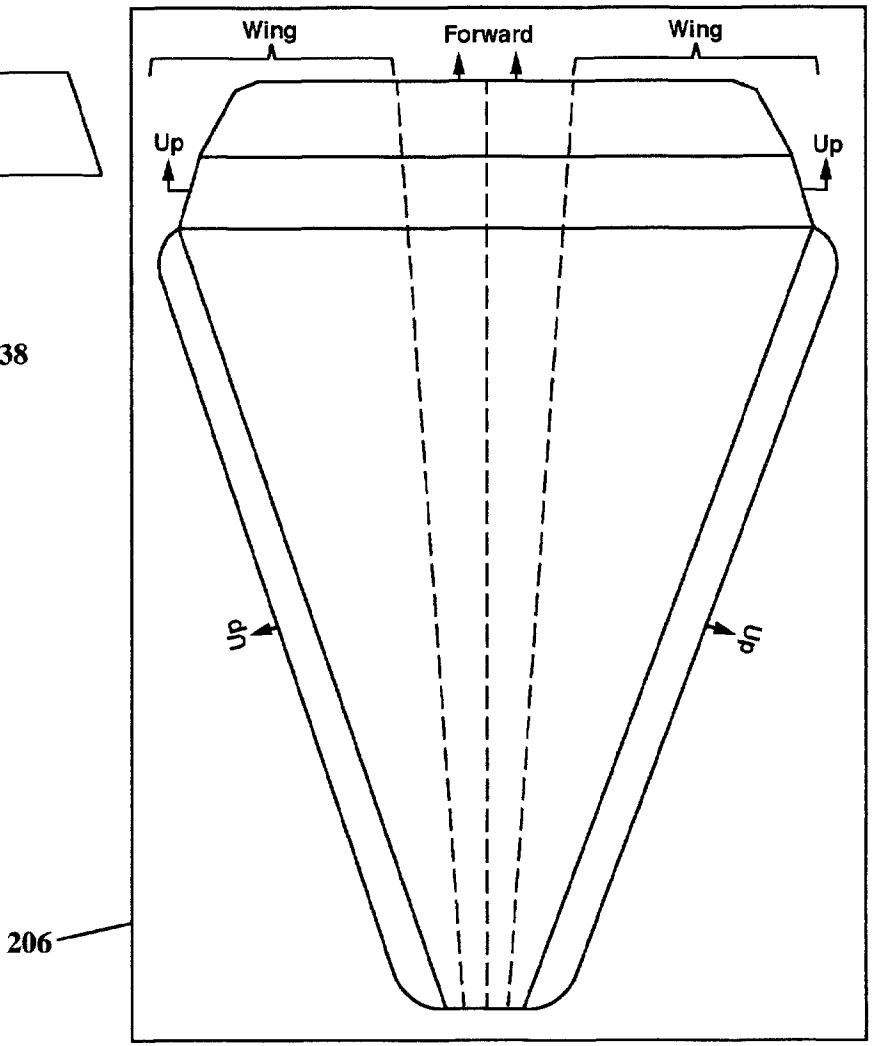

FIG. 11 depicts a multi-purpose food-serving apparatus design template of the type that can be stored as a computer file and accessed by one or more users from a computer-record storing medium or apparatus, or downloaded from a user-accessible computer network, for example, a website, or FTP site. The file can be downloaded, printed, user-edited and uploaded, for example, in a contest for the best food-service apparatus design.

Figure 12:
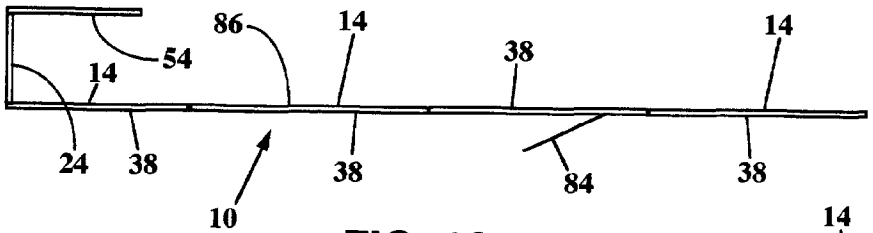
Figure 15:
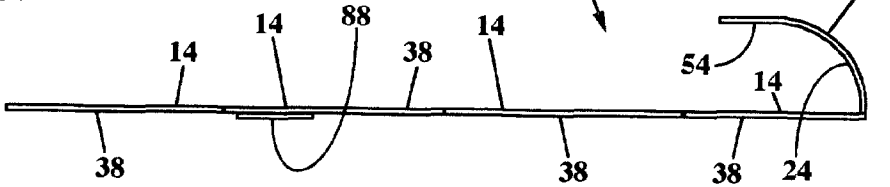
Figure 13:
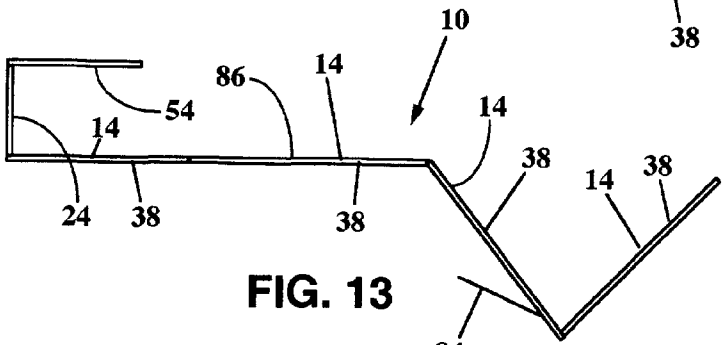
Figure 16:
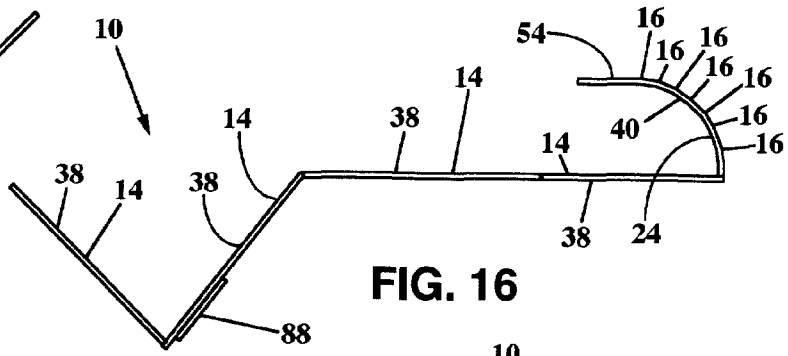
Figure 14:
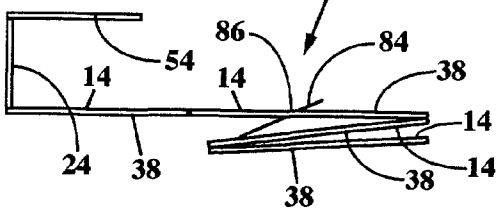
Figure 17:
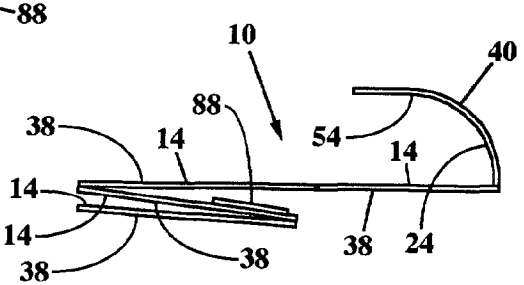

FIGS. 12 through 17 diagrammatically illustrate a method of folding a multi-purpose food-serving apparatus such that a user can minimize or prevent his fingers from contacting one or more food-supporting surfaces of the apparatus during the use of the apparatus. FIGS. 12–14 show an optional interlocking action between a segment tab and segment slot. FIGS. 15–17 show an optional attachment means between an adhesive seal and the lower surface of the apparatus. FIGS. 15–17 also show an optional rounded contour of a rear food-retaining portion wherein the portion is pre-curved, or ribbed, or has a plurality of bendable cross-sections to facilitate curving of the portion by a user (rear view shown in FIG. 47).

Figure 19:
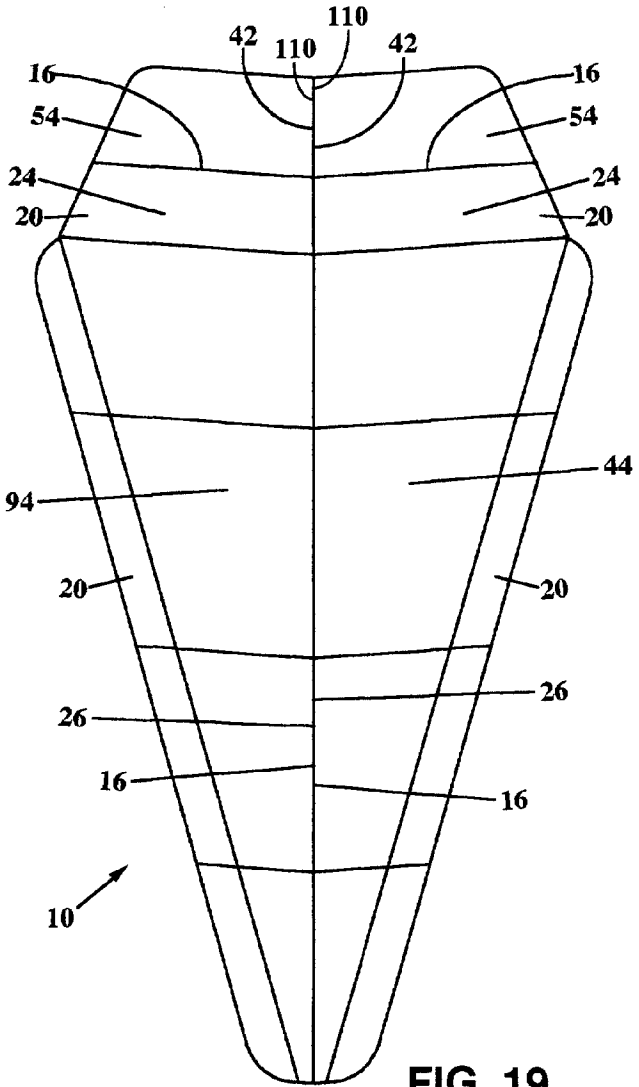
Figure 18:
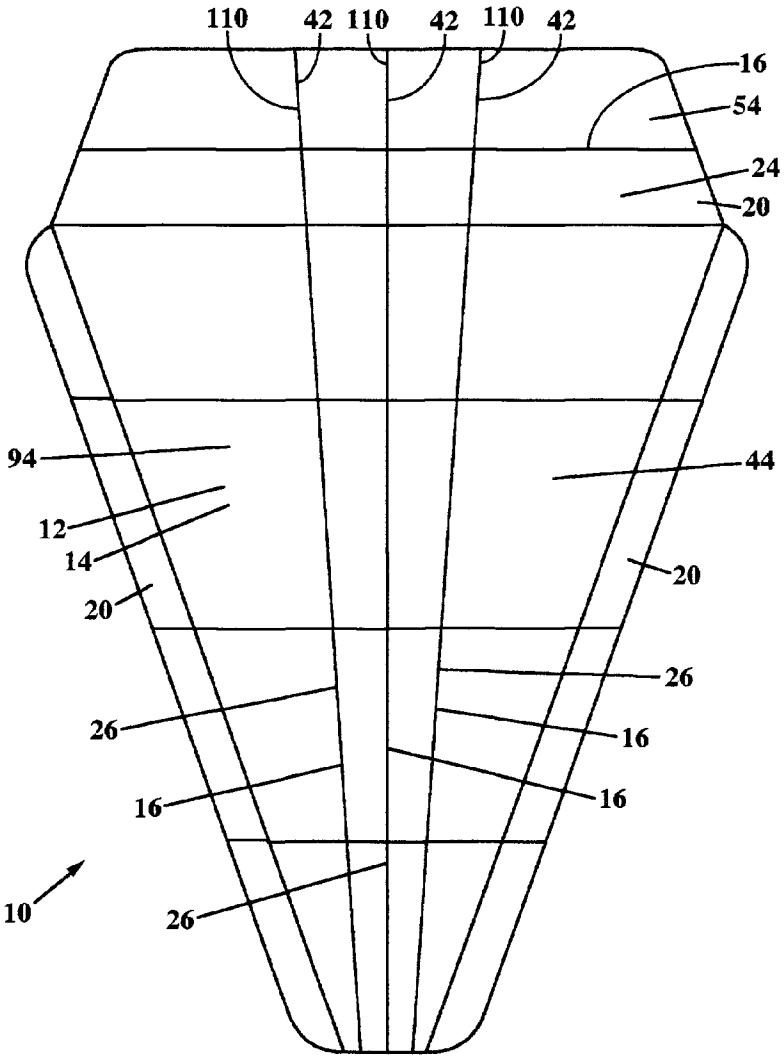
Figure 21:
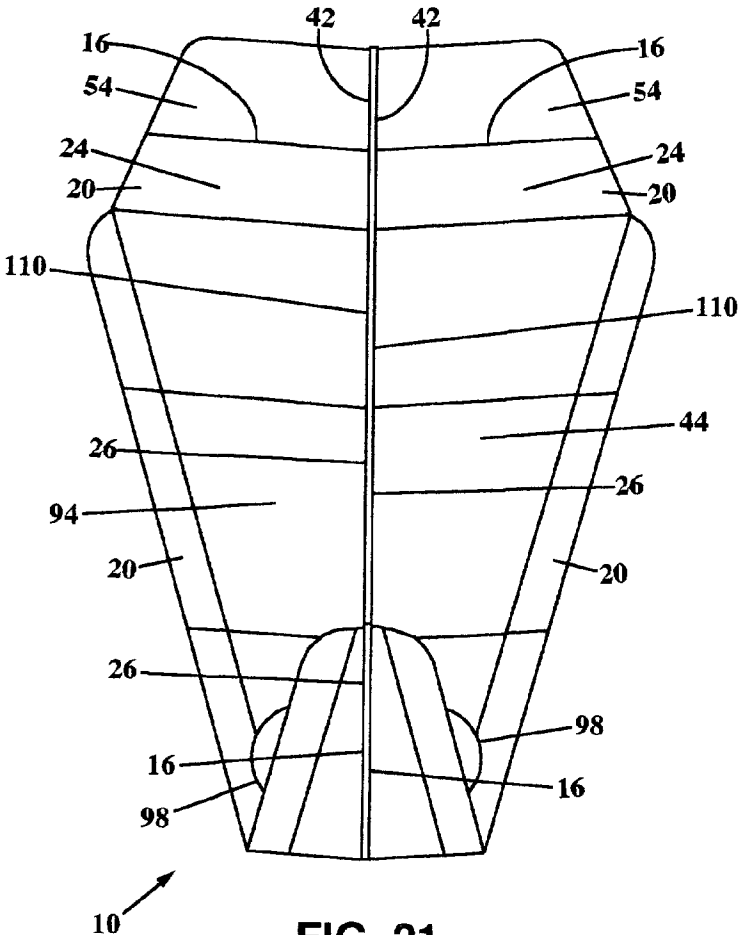
Figure 20:
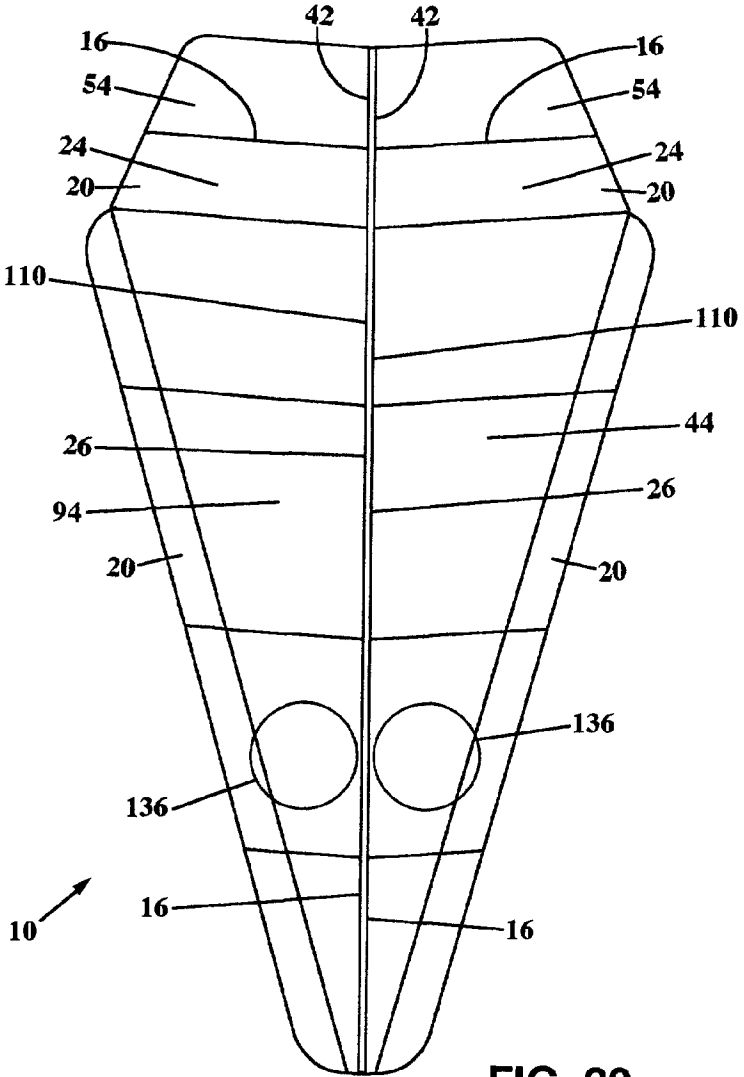
Figure 22:
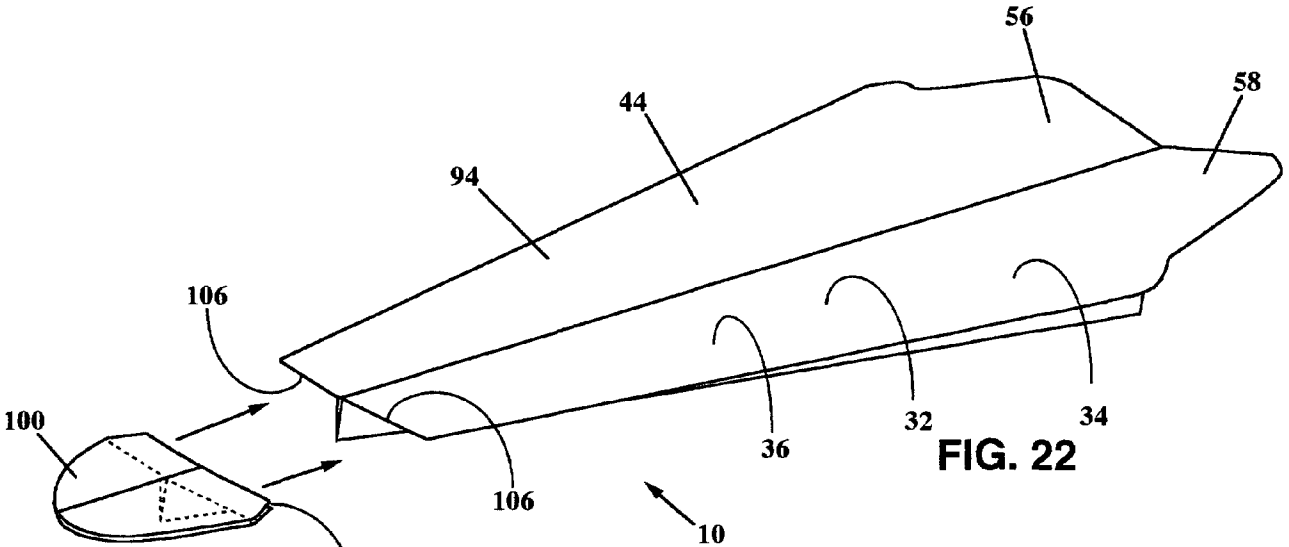
Figure 23:
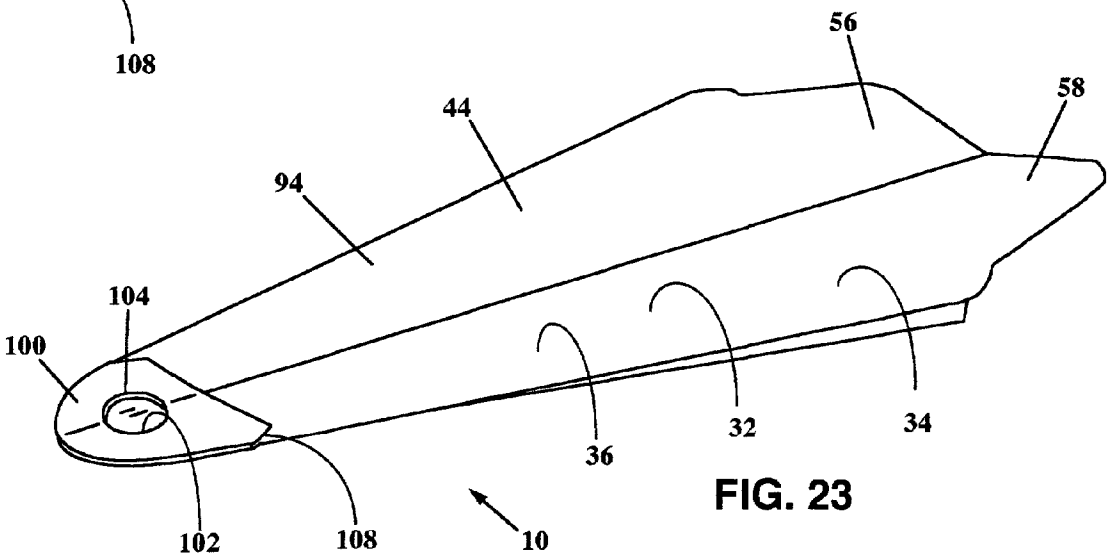

FIGS. 18 through 22 illustrate a variant of a multi-purpose food-serving apparatus employable in its entirety as a flyable airplane. FIGS. 18 and 19 are top views, before and after respectively, of the folding of the apparatus. FIG. 20 is a bottom view of the airplane shown in FIG. 19 and FIG. 21 is a similar, but shorter airplane having a front nose segment that is folded backward. FIGS. 22 and 23 are three-dimensional views showing before and after views of a slotted nose piece which slides onto the front of the airplane. FIG. 18 shows fold lines, or indicia, or reduced cross-sections, or any combination thereof, which facilitates the folding of the apparatus by a user into an airplane shape. FIG. 20 has weight placement indicia to indicate to a user where weights such as one or more coins can be added to create an optimal center of gravity. In FIG. 21, coins are added to the plane before the front segment is bent backward.

Figure 25:
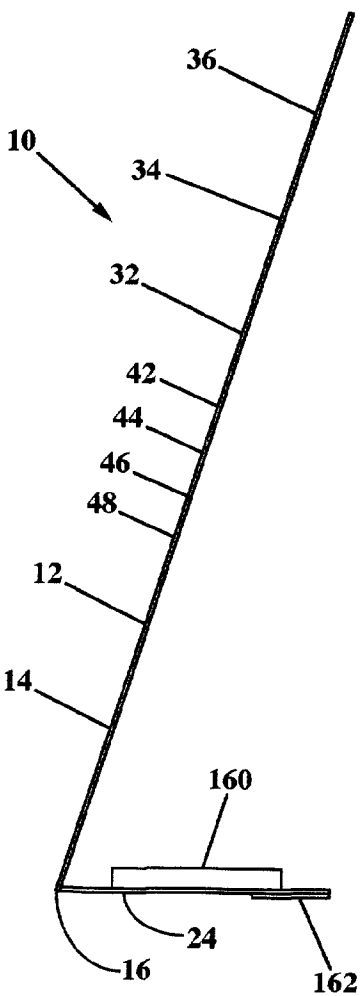
Figure 24:
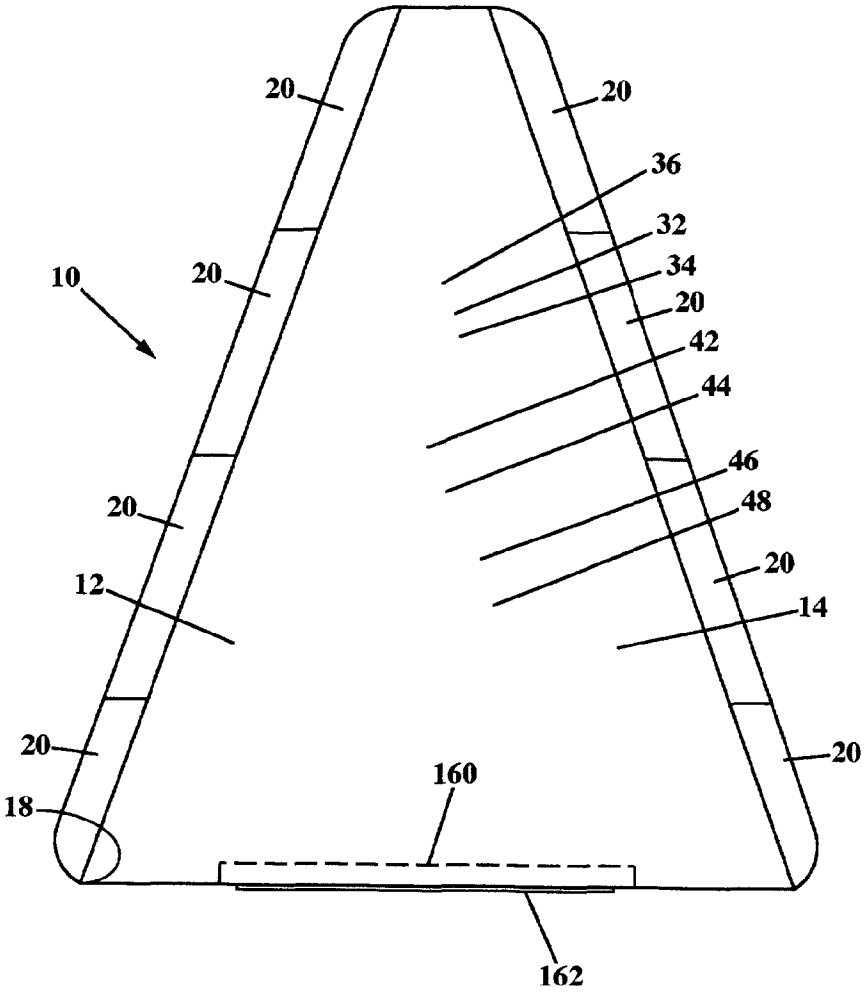
Figure 27:
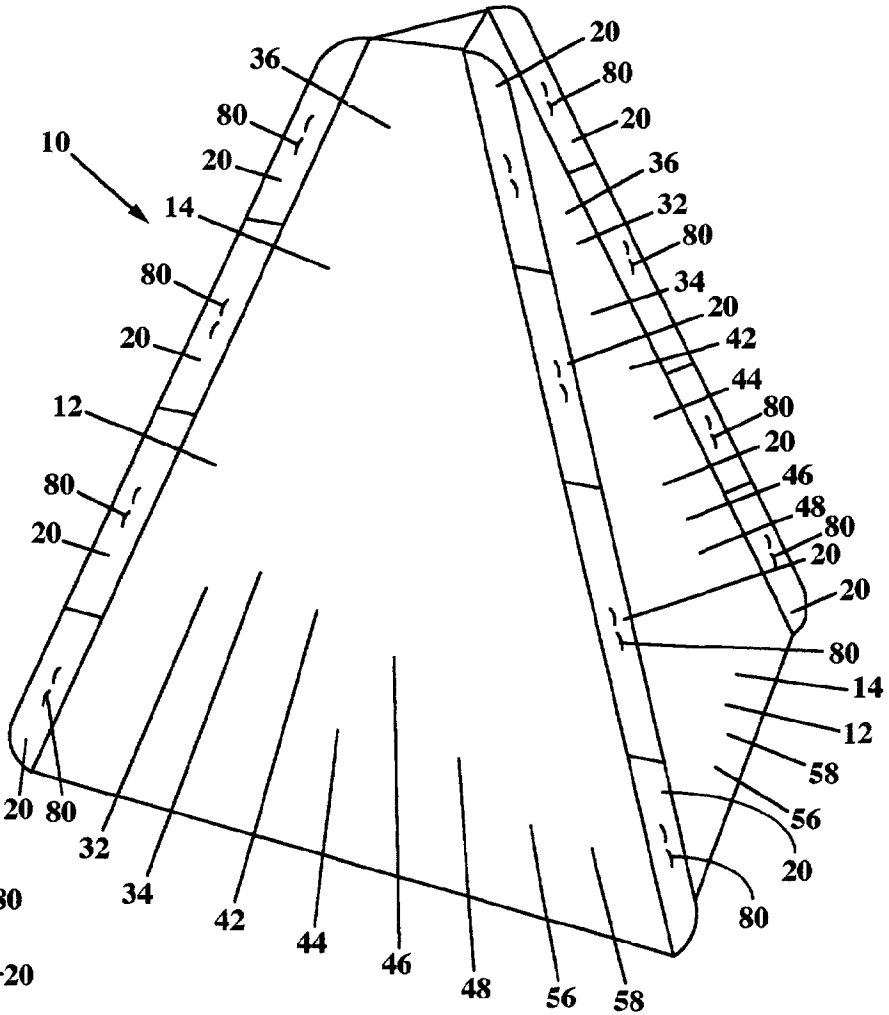
Figure 26:
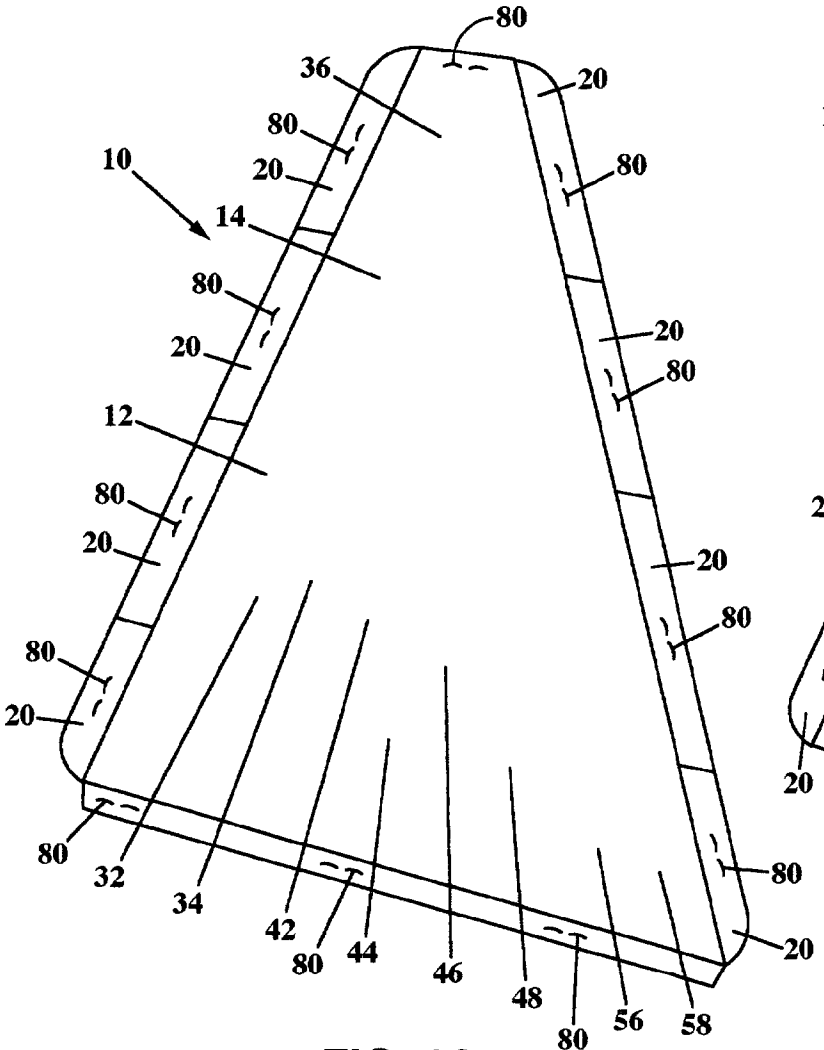

FIGS. 24 through 27 illustrate a variant of a multi-purpose food-serving apparatus employable in its entirety as a self-standing display, or exhibiting means upon which user-discernable and/or observer-discernable content can be displayed, such as any one or more of the contents described above. In FIGS. 24 and 25 an end portion of the apparatus is bent backward and optionally weighted and/or comprised of an attachment means to position the apparatus on a flat surface. In FIG. 26 two apparatus are attached to one another to form a two-sided display means that can optionally be filled with a multiplicity of small hard elements to provide a noise-making device. In FIG. 27, a plurality of apparatus are attached to one another to form a self-standing display, or exhibiting means.

Figure 29:
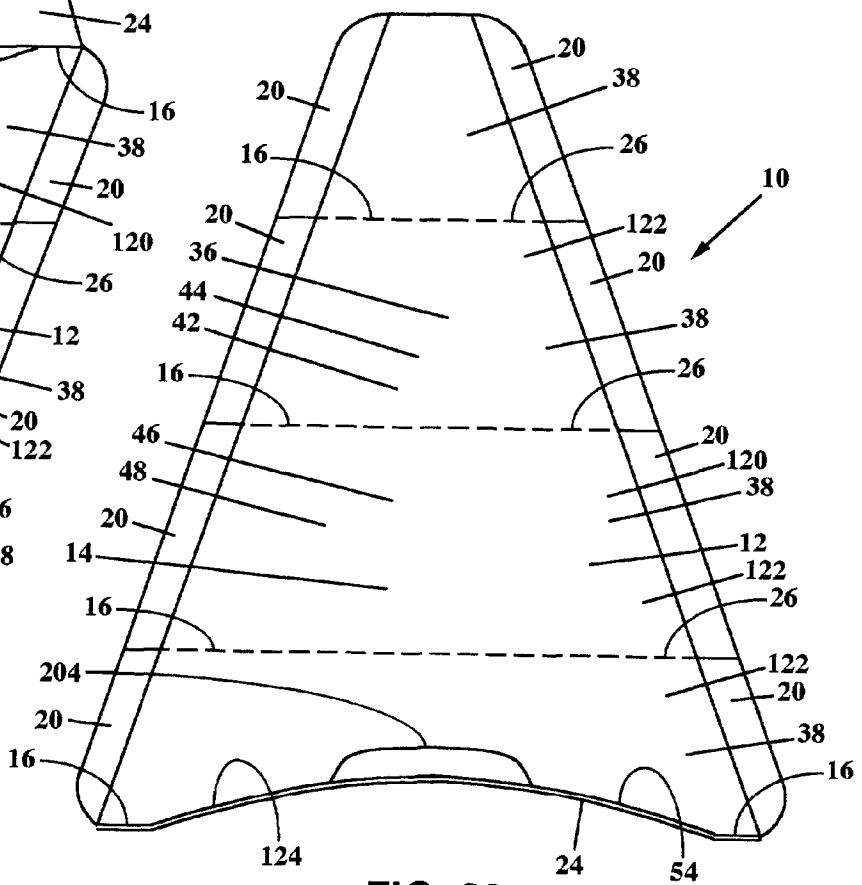
Figure 28:
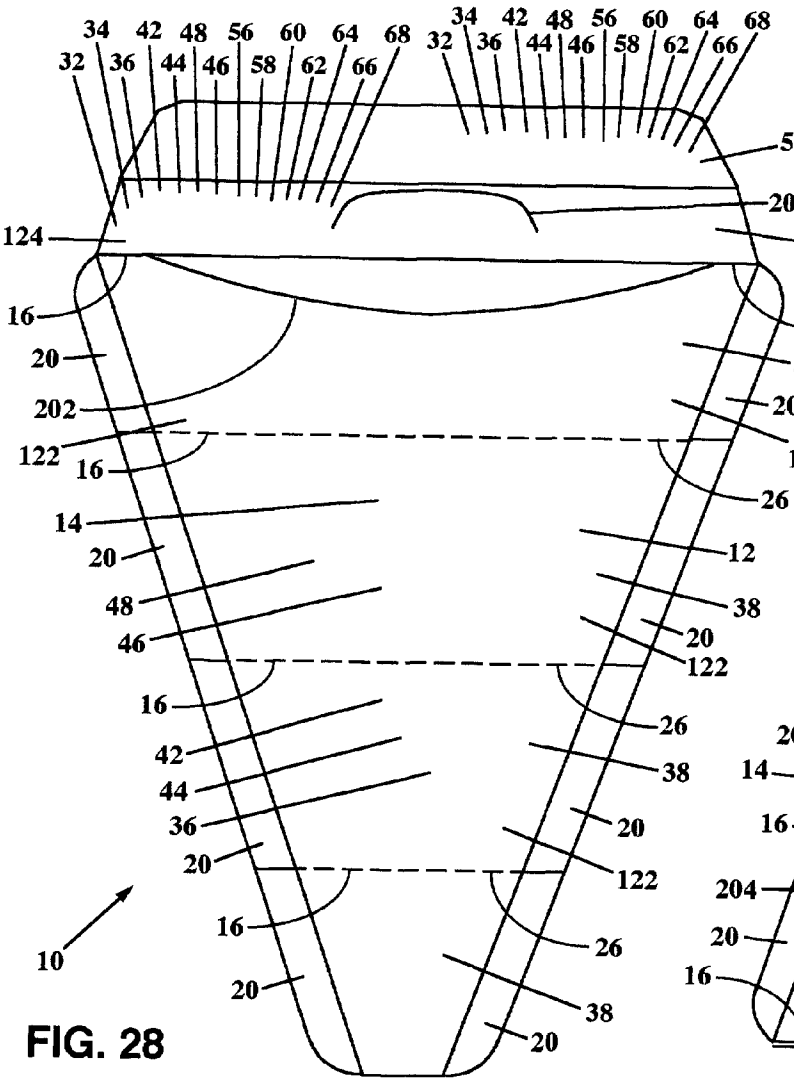
Figure 30:
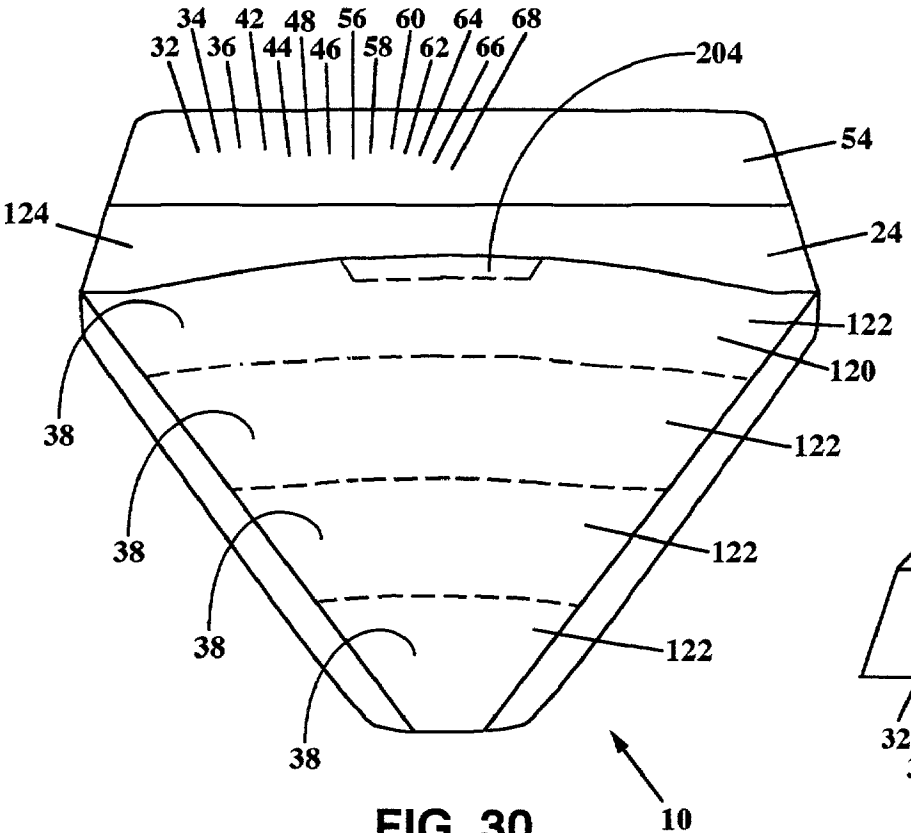

FIGS. 28 through 30 illustrate a variant of a multi-purpose food-serving apparatus employable in its entirety as a visor, and the visor having one or more surfaces upon which user-discernable and/or observer-discernable content can be displayed, such as any one or more of the contents described above. Top views of the visor, before and after the bending of the apparatus, are shown in FIGS. 28 and 29 respectively. FIG. 30 is a three-dimensional front view of the visor.

Figure 31:
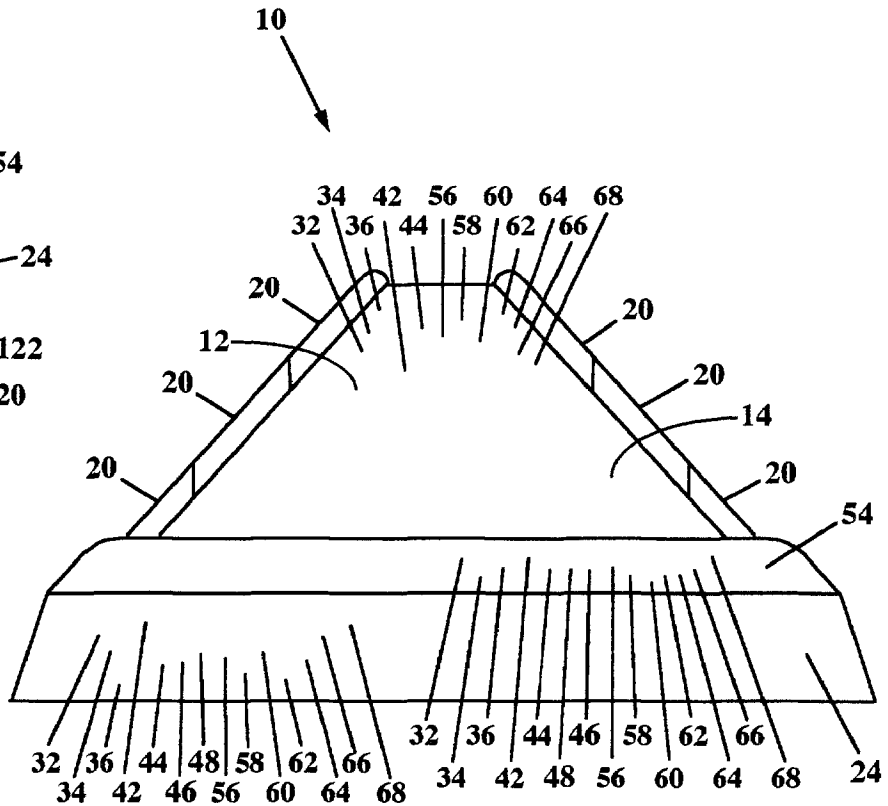

FIG. 31 is a three-dimensional rear view of a variant of a multi-purpose food-serving apparatus in a resting position, illustrating the apparatus having one or more surfaces upon which user-discernable and/or observer-discernable content can be displayed, such as any one or more of the contents previously described.

Figure 33:
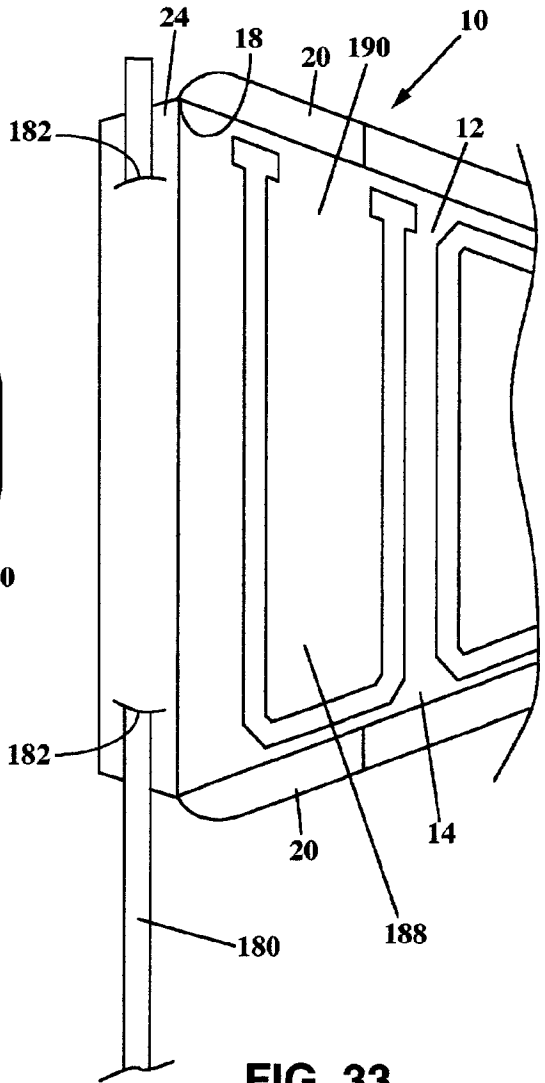
Figure 32:
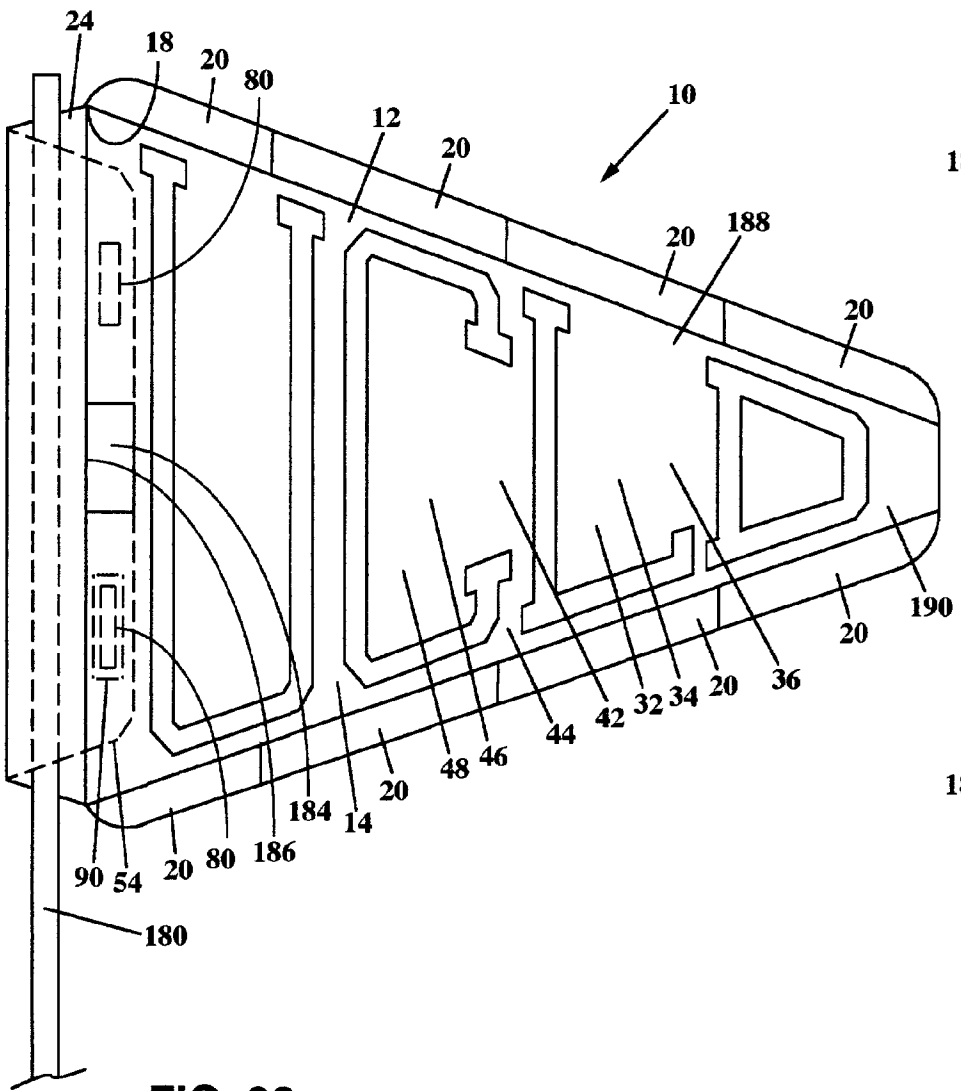

FIGS. 32 and 33 illustrate the employment of a variant of a multi-purpose food-serving apparatus as a pennant, and the pennant having one or more surfaces upon which the name of one or more schools, or sports teams, or logos can be displayed. In FIG. 32 an end of the apparatus is foldable and interlocking to receive the end of an elongated support member such as a plastic or metal rod or tube, or a wood dowel. In FIG. 33, the end of an elongated support member is insertable into one or more slots.

Figure 34:
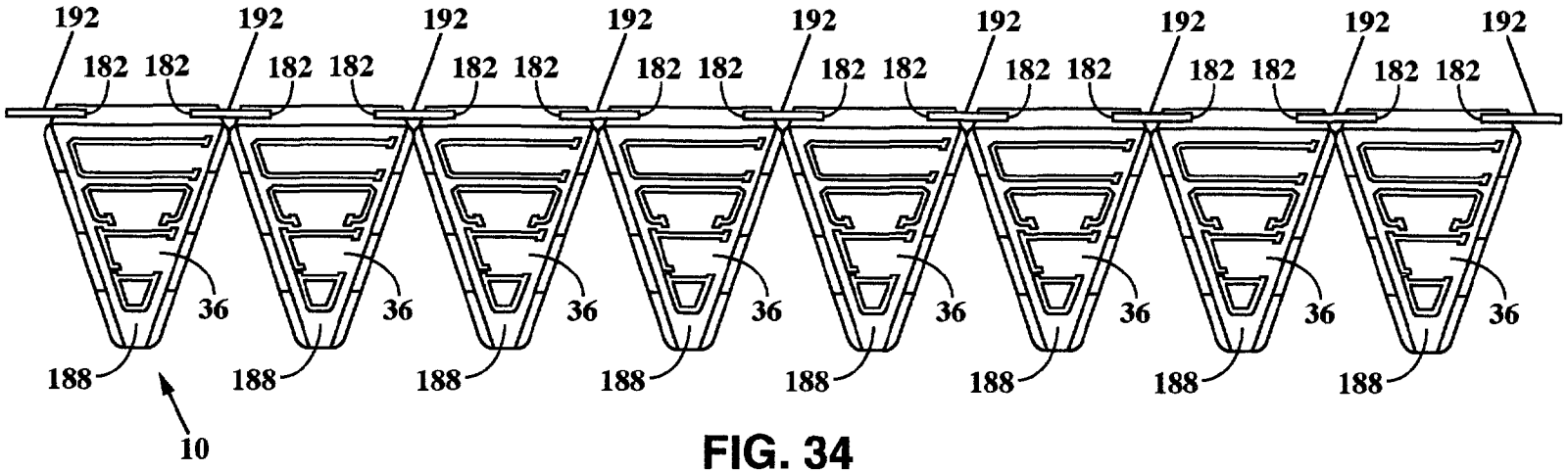
Figure 35:
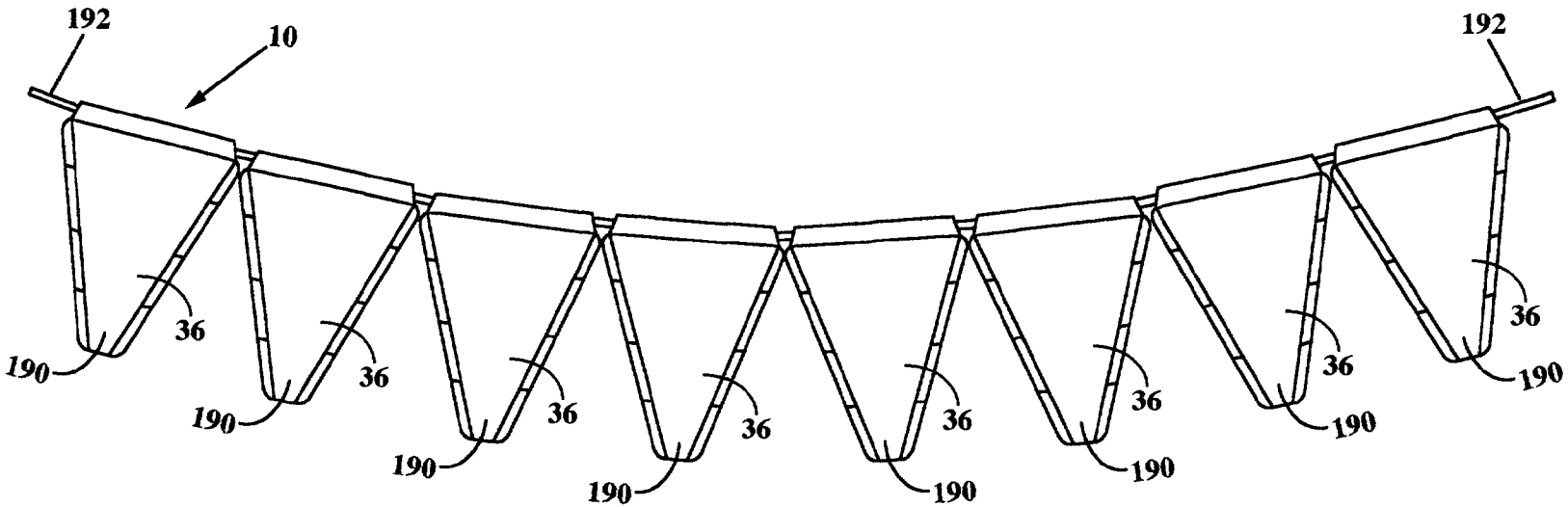

FIGS. 34 and 35 illustrate the employment of a variant of a multi-purpose food-serving apparatus wherein numerous apparatus are suspended in FIG. 34 as a streamer of pennants, and in FIG. 35 as a streamer of flags. The pennants have one or more surfaces upon which indicia, other viewable content, or the name of one or more school, or sports team, can be displayed. The flags have one or more surfaces upon which at least one color, or user-discernable and/or observer-discernable content can be rendered, such as any one or more of the contents previously described.

Figure 37:
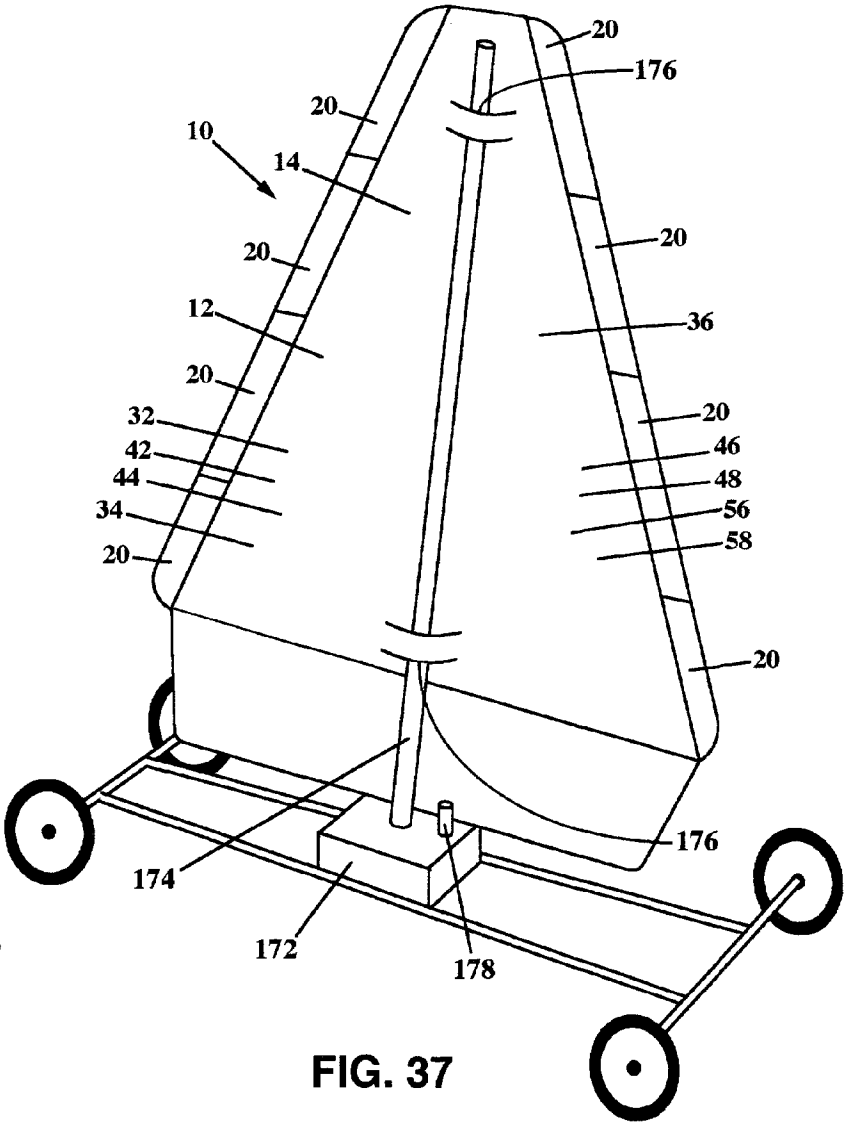
Figure 36:
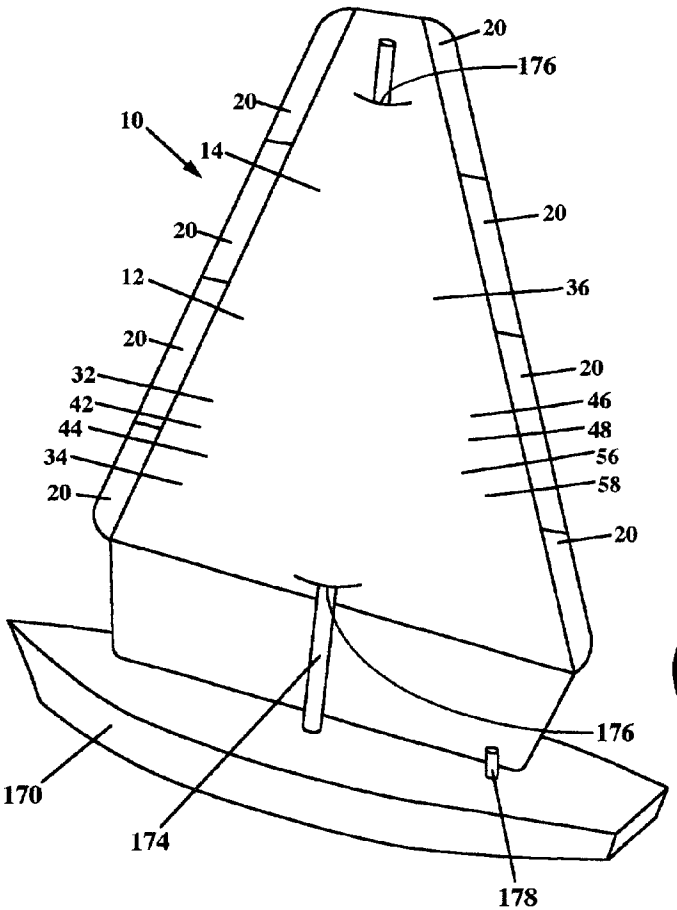

FIGS. 36 and 37 are three-dimensional views depicting a variant of a multi-purpose food-serving apparatus employable in its entirety as a sailable toy, and the sailable toy having one or more surfaces upon which user-discernable and/or observer-discernable content can be displayed, such as any one or more of the contents referred to above. In FIG. 36, the sailable toy is a sailboat, in FIG. 37, the sailable toy is a land-sailing toy with wheels.

Figure 38:
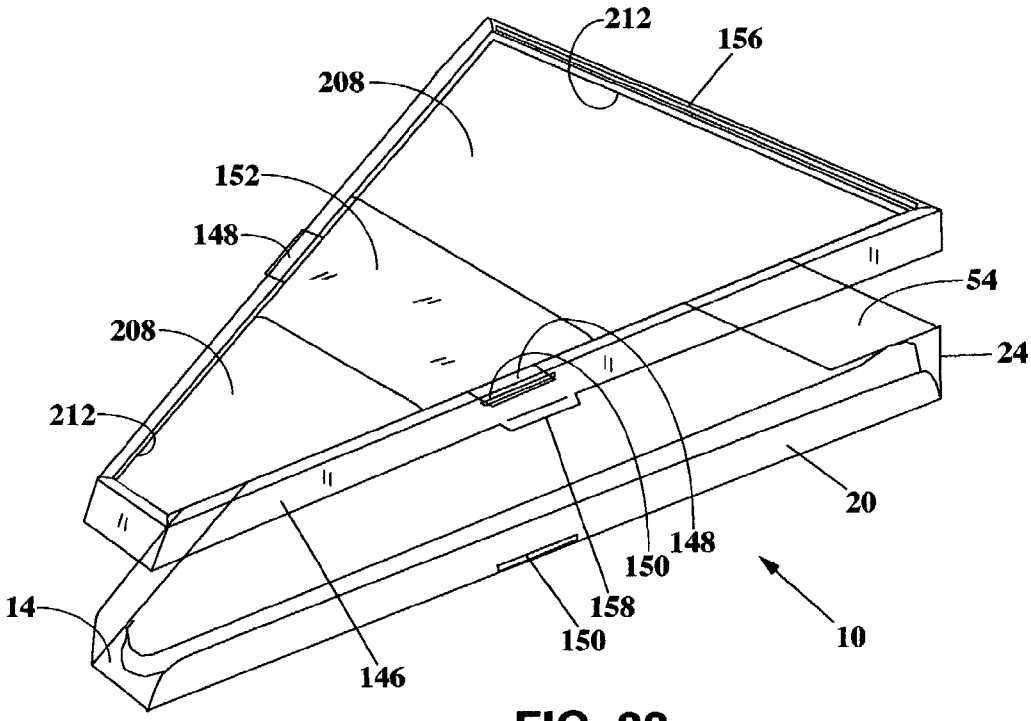
Figure 39:
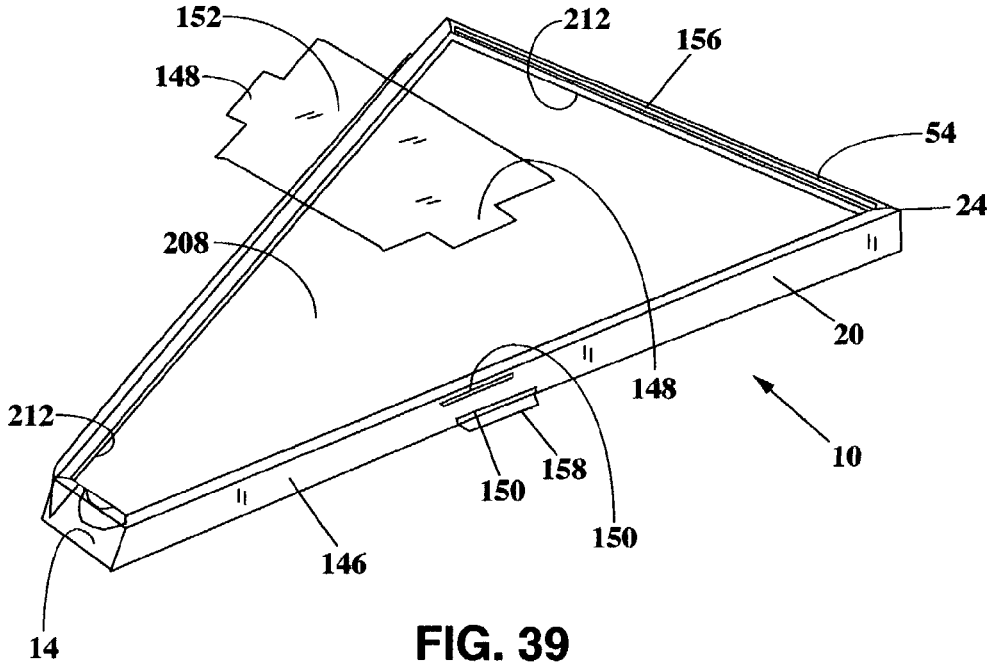
Figure 40:
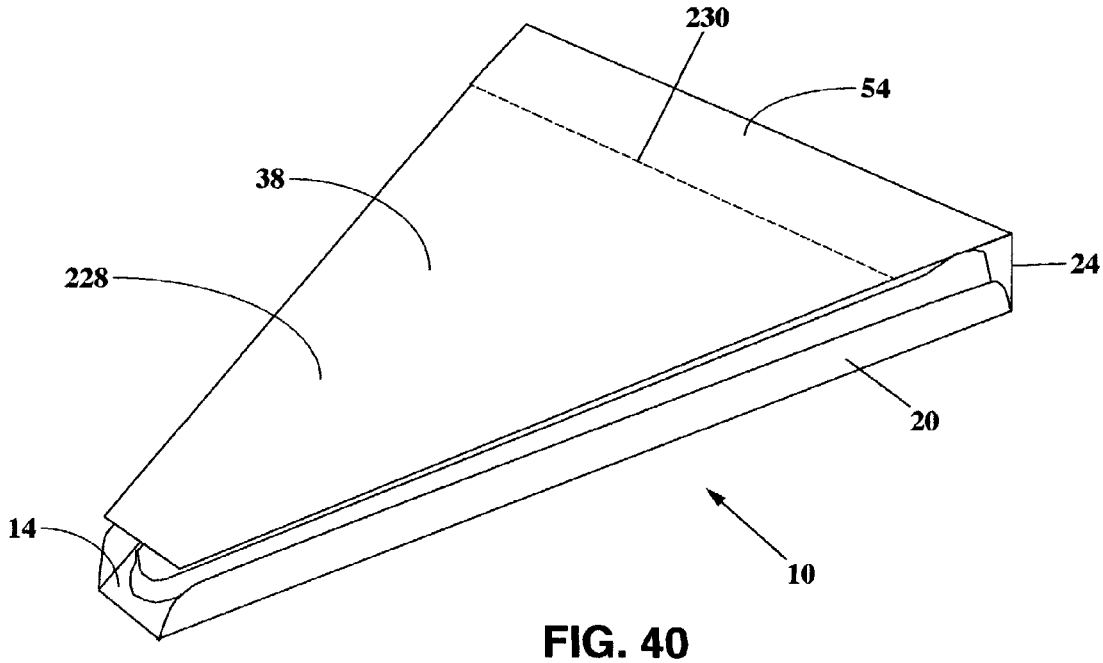
Figure 41:
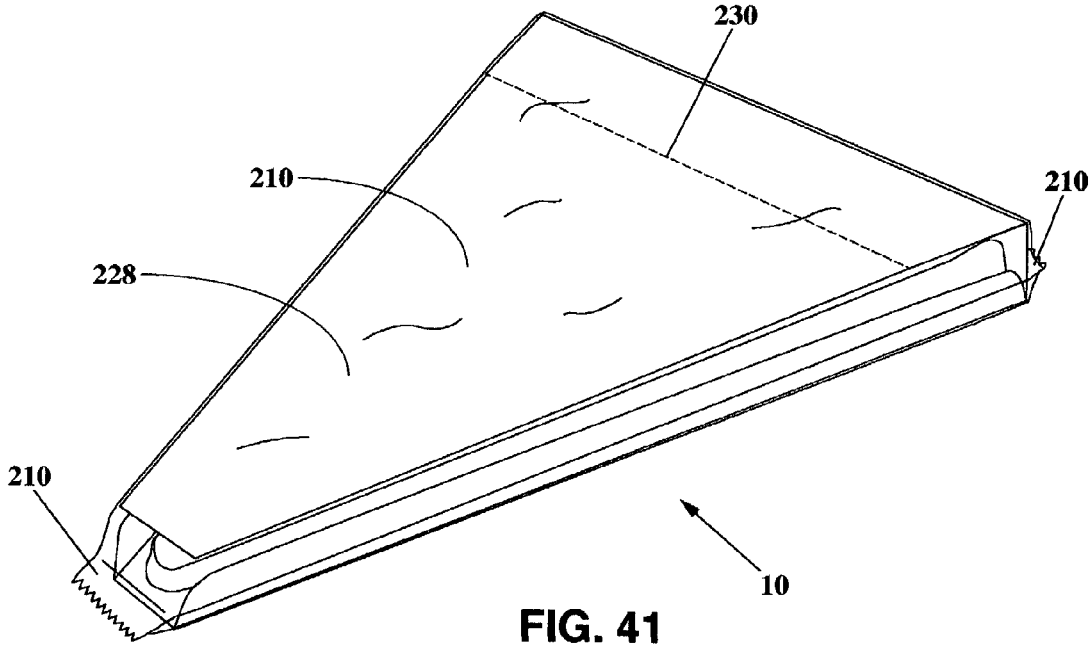

FIGS. 38 and 39 are three-dimensional views depicting a variant of a multi-purpose food-serving apparatus having a detachable lid with a number of tabs that can slideably fit in respectively aligned slots in the apparatus to secure the lid thereto. The lid is shown being recessed to receive one or more napkins, the latter of which can be retained by a napkin-securing means. In one variant of the combination lid and tray, the upper tab of the tray can also slideably fit within a rearward slot of the lid to further facilitate the retention of the lid to the tray. FIGS. 40 and 41 are three-dimensional views depicting a variant of a multi-purpose food-serving apparatus having a clamshell configuration including an upper lid portion extending forward from the front edge of the upper tab of the tray. The lid portion is attached to the tab at a reduced cross-section such as a perforation and/or score which facilitates a tear off utility allowing the user to easily remove the lid portion from the tab. In FIG. 41, the tray and lid portion are shown sealed within a protective wrap. The tear off lid portion can optionally include one or more side walls, including walls with slots and/or tabs such as those depicted in FIGS. 38 and 39.

Figure 42:
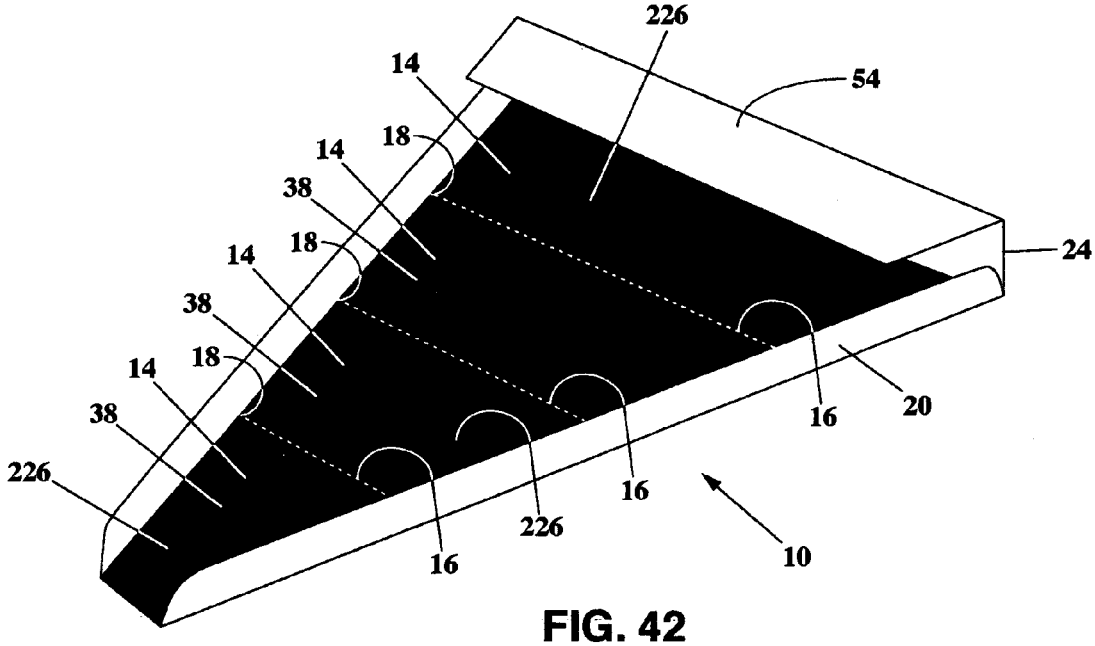
Figure 43:
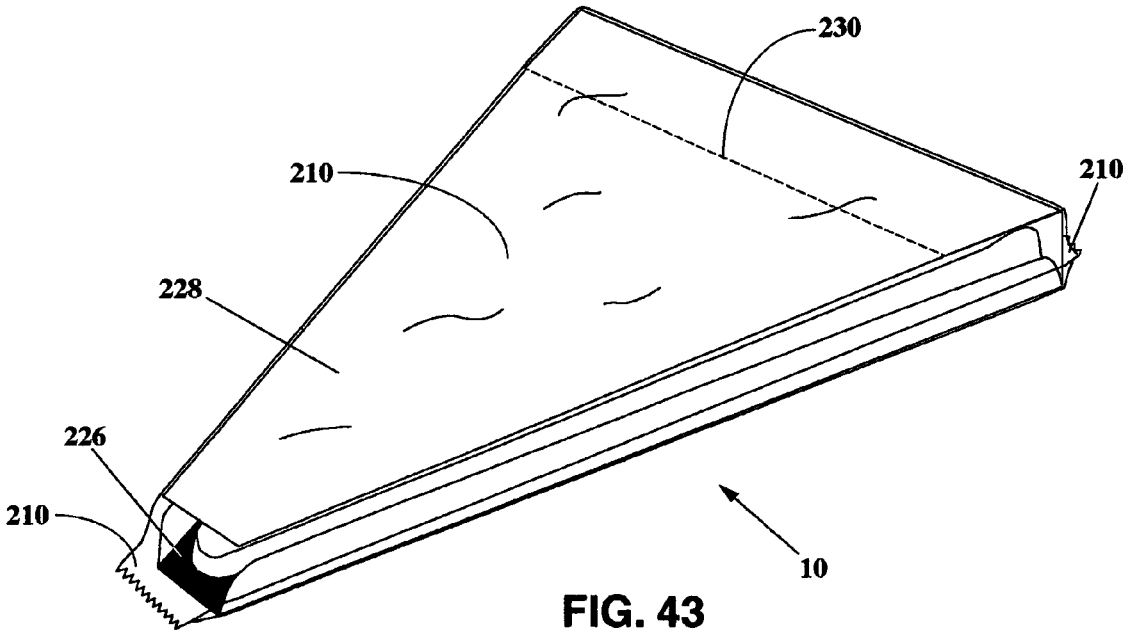

FIGS. 42 and 43 are three-dimensional views depicting a variant of a multi-purpose food-serving apparatus having a susceptor material, or Radiation Absorbing Material (RAM), (shown in black) to facilitate rapid heating of the food item(s) resting on the material, when cooked in a microwave oven, or other heating device. In FIG. 43, the tray and a lid portion are shown sealed within a protective wrap.

Figures 44, 45, 46, 47:
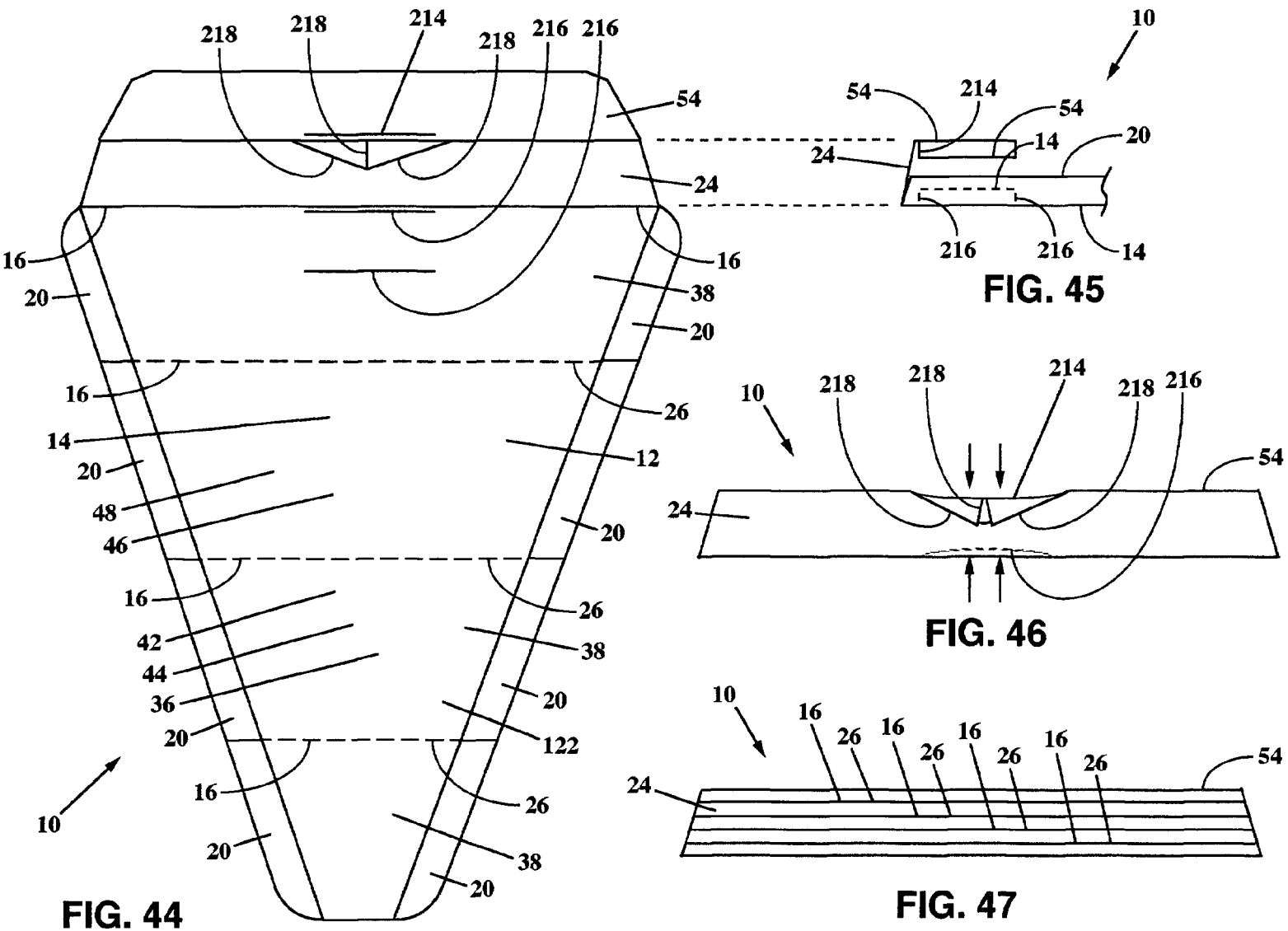

FIG. 44 is a top view of a flat MPFSA prior to being folded for use, illustrating how one or more slits through the apparatus material create a pinch zone allowing one or more portions of the apparatus to bend more easily nearest to the slit(s).

FIG. 45 is a partial side view of an end of a MPFSA after being bent for use, illustrating how a tab slit can allow the tab, in the region of the slit, to more easily bend downward to facilitate the pinching of a pizza crust or other served food item(s). Similarly, a tray slit can allow the tray, in the region of the slit, to more easily bend upward to facilitate the pinching of a pizza crust or other served food item(s). The figure also illustrates how combinations of tab and tray slits can be employed.

FIG. 46 is a rear view of the MPFSA illustrating how rear panel slits (also seen in FIG. 42) can give way to allow to allow a downward bending of the tab (at arrows) to facilitate the pinching of a pizza crust or other served food item(s). The figure also illustrates how combinations of rear panel slits and tray slits can be employed.

FIG. 47 is an end view of a variant of the apparatus having a plurality of bendable cross-sections or reduced cross-sections to facilitate the bending of a rear food-retaining portion of the apparatus around the shape of the food item(s) being served (side view shown in FIG. 16).

Figure 48A:
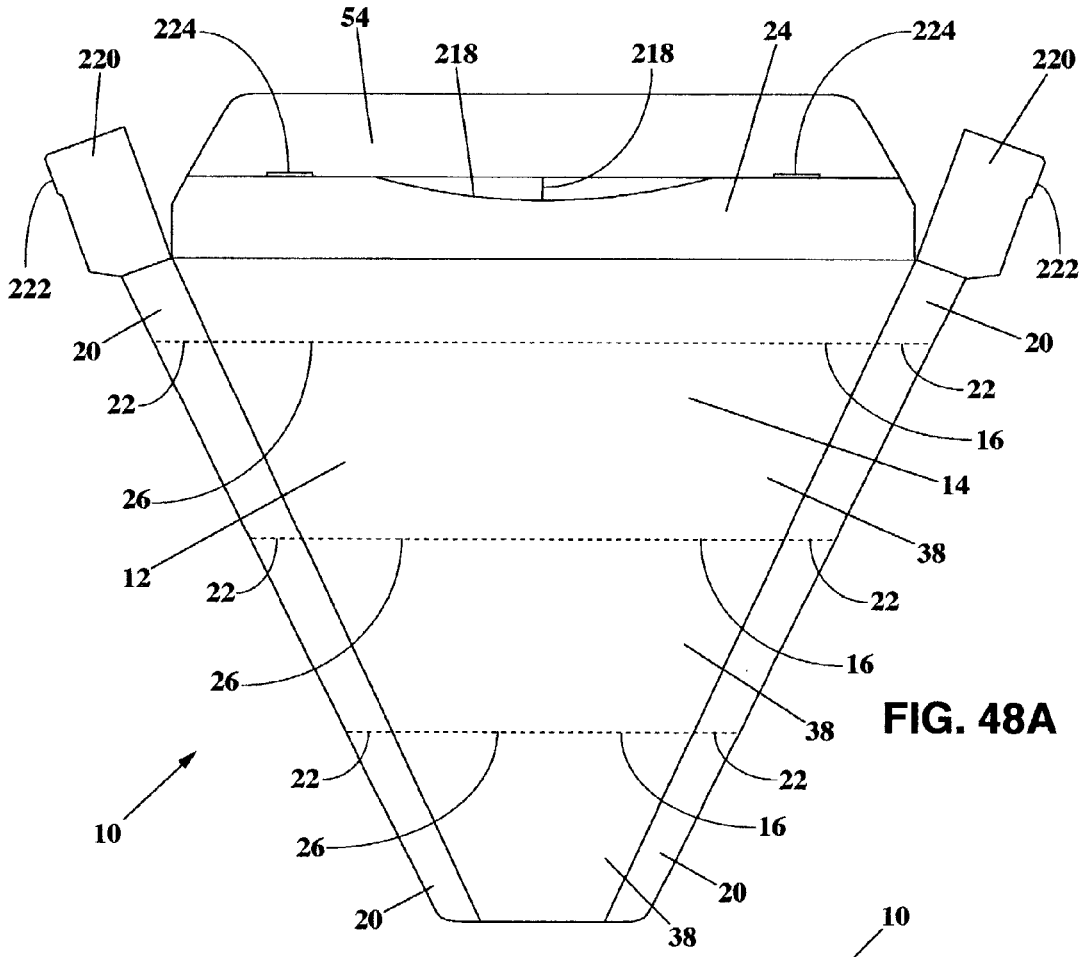
Figure 48B:
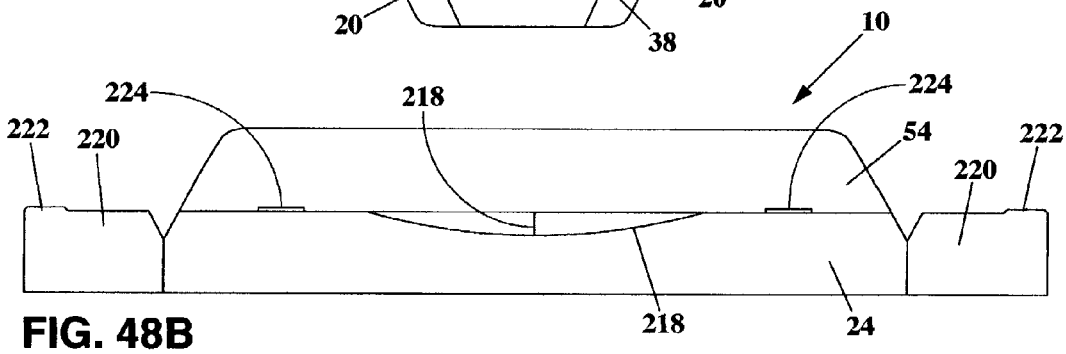
Figure 48C:
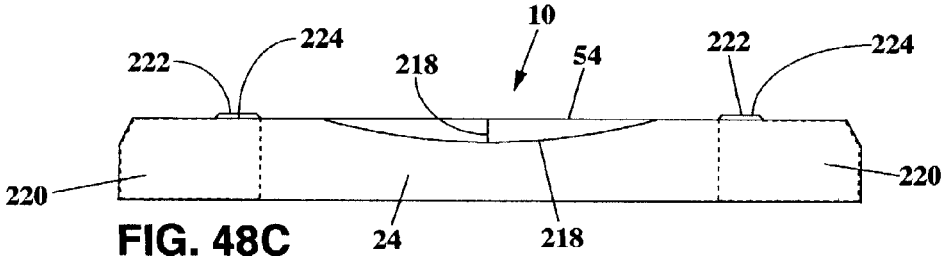

FIG. 48A is a top view of a flat MPFSA prior to being folded for use, and FIGS. 48B and 48C are rear views of a MPFSA after being partially folded and completely folded respectively, wherein each figure illustrates how a foldable-tab extending from a rearward end of a food-retaining portion can be employed in a quick-assembly manner to interfit within a rear portion of the apparatus to increase the strength of the apparatus after it is folded for use.

DETAILED DESCRIPTION OF THE PREFERRED EMBODIMENT

The present invention is a view-as-you-eat and/or folds-as-you-eat multi-purpose food-serving apparatus ('MPFSA') that can have any one or more of a variety of sizes and shapes including, but not limited to: round, or elliptical, or square, or rectangular, food-supporting members. The apparatus is preferably sized and shaped to the size and perimeter-shape of food intended to be served thereon, including, but not limited to, serving one or more of the following: pizza slice(s) or smaller whole pizzas, Mexican pizza(s) or slices thereof, fruit portion(s), watermelon slice (s), melon slice(s), pie slice(s), ice cream sandwich(es) or other value-added ice creams, quiche, hash browns, hamburger(s), hot dog(s), Hoagie's, submarine sandwich(es), French dip sandwich(es), sandwich(es), burrito(s), quesadilla(s), waffle(s), chicken filet(s), chicken strip(s), chicken portion(s), poultry portion, fish filet(s) or other fish portion, 'finger food(s)', hors douvre(s), dessert(s), and so forth.

For the purpose of describing the present invention, the multi-purpose food serving apparatus 'MPFSA' will be described as a plate or tray for serving a slice of pizza however, it is to be noted that the utility of the invention is applicable to the serving of numerous types of foods, each of which, can be served on trays or plates that are optimally shaped to serve one or more food items. The MPFSA, or lids for such, can be made out of a wide range of materials having suffient rigidity such as materials including but not limited to: materials suitable for use in a dishwasher, a refrigeration device, a heating device, a microwave oven, a combination microwave and conventional oven, material which can tolerate multiple bending cycles, multiple washing cycles, materials that are recycled and/or biodegradable. MPFSA can be made out of paper, papercard, one or more flexible metals or plastics, and the like. Portions of the MPFSA can also include other, or combinations of materials and will be described in the following pages. The MPFSA can be made in a variety of shapes including but not limited to shapes that are round, rectangular, elliptical, oval, ovoidal, asymmetrical, and the like. For example when a MPFSA is triangular in shape it can serve food selected from the group consisting of triangular shaped foods such as pizza, pie, dessert, and quiche. When the apparatus is substantially semicircular in shape to accommodate the serving of food selected from the group consisting of tacos, calzones, hamburgers, sandwiches and pita sandwiches. The apparatus can also be shaped to slideably fit into, and be easily removed from, a food dispensing compartment of a vending machine.

Figure 1:
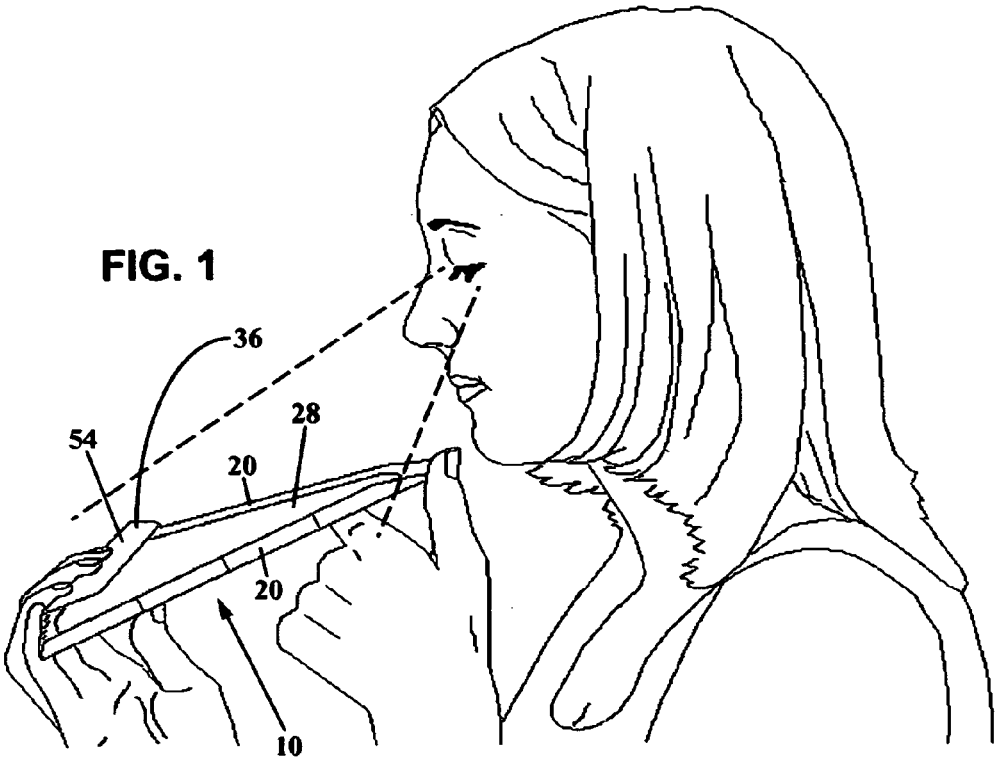
FIG. 1 is a three-dimensional depiction of a person holding a variant of a multi-purpose food-serving apparatus (MPFSA) illustrating that much of the upper surfaces of the apparatus are, within the field of view of the person, and are employable as an exhibiting means to display user-discernable content, as she is about to take a bite, or while she is taking a bite, of food served on the apparatus.
Figure 2:
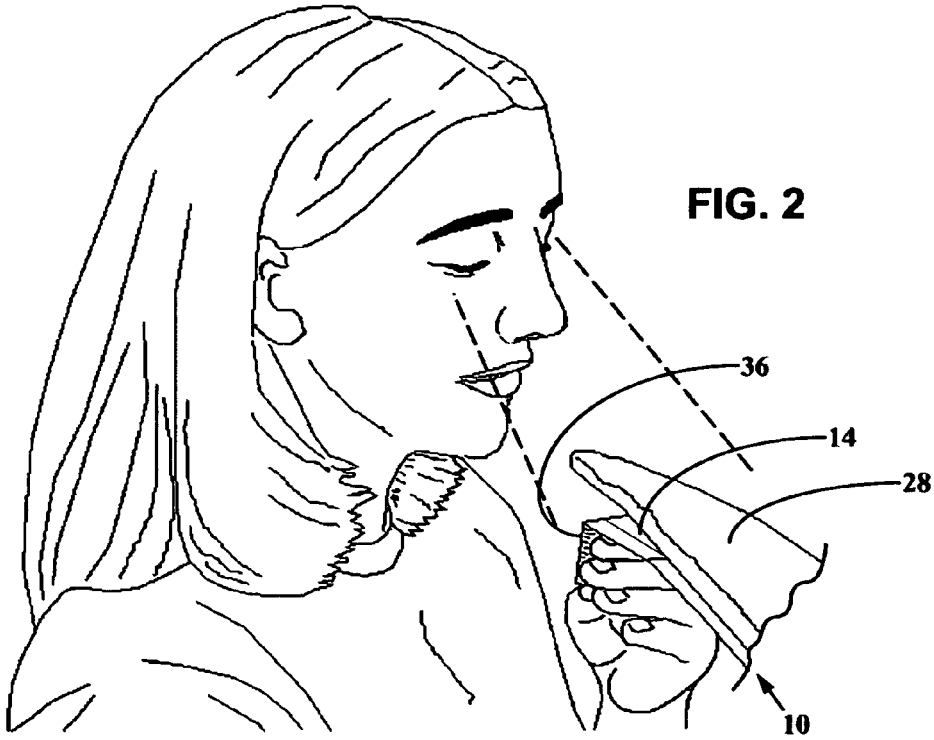
FIG. 2 is a three-dimensional view similar to FIG. 1, illustrating that upper surfaces of the apparatus are within the field of view of the person as she 1.) positions one or more segments of the apparatus downward, or 2.) as she eats portions of the food served on the apparatus which reveals user-discernable content on one or more of the upper surfaces of the apparatus.
Figure 3:
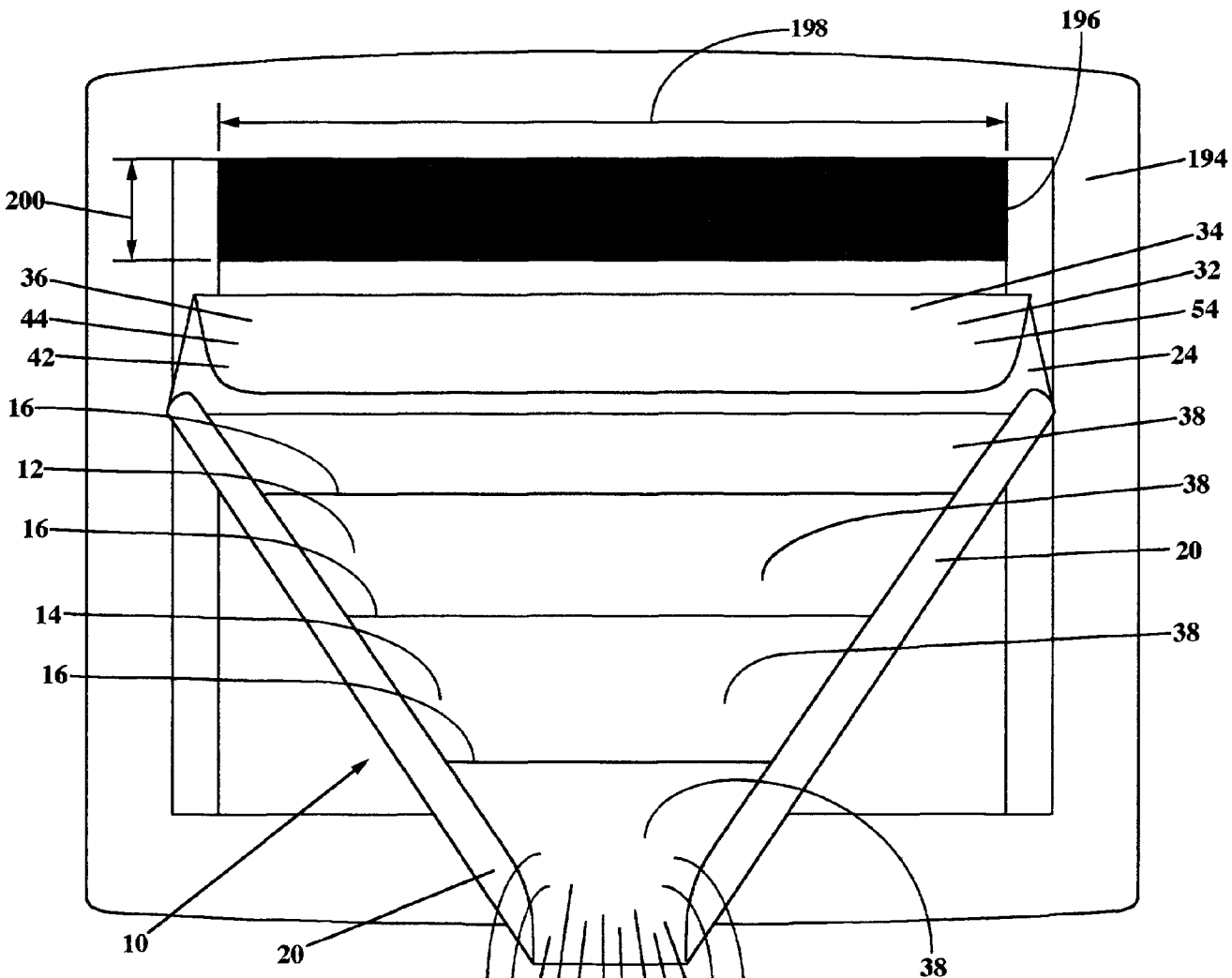
FIG. 3 is a three-dimensional front view of a multi-purpose food-serving apparatus (MPFSA) illustrating the relative size of an upper surface of a food-retention tab of an apparatus, when the apparatus is held by a user in a position similar to that of FIG. 1 or FIG. 2, compared to the height and width of a screen-wide banner ad as it would appear on a large computer monitor situated in front of the user.

As can be seen in FIGS. 1 through 9, the present invention is a multi-purpose food-serving apparatus 10 hereinafter referred to as 'MPFSA' that is substantially sized and shaped to the size and shape of at least one item of food intended to be served thereon. The apparatus is comprised of a food-supporting member 12 consisting of a material sized, and having sufficient rigidity, to serve and support one or more items of food. In FIG. 3, the food-supporting member 12 is shown having at least one food-retaining portion 20 integrally formed adjacent thereto which extends upward, relative to a food-supporting surface of the member, in a manner which increases the rigidity of the food-supporting member. The food-retaining portion(s) 20 is sized, having sufficient rigidity, to facilitate an alignment and retention of the food-item(s) when placed on the food-supporting member 12. The food-supporting member has at least one bendable cross-section 16 extending across the food-supporting member 12. Alternatively, food-supporting member can have a plurality of bendable cross-sections each extending across a width of the member an each aligned with at least one reduced-cross-section to provide a user-selectable bending of the food-supporting member at any combination of the bendable cross-section and adjacent reduced-cross-section (s). In FIGS. 6 through 9 an embodiment of the apparatus is shown before the food-retaining portions 20 are formed or positioned upward and bendable cross-section ends 18 are provided to predispose a bending of the food-supporting member 12 between two bendable cross-section ends 18. For example, the food-supporting member 12 can be made with one or more bendable cross-sections 16 comprised of one or more perforations, or one or more scores, or one or more combined perforation(s) and score(s), and can be aligned between two cross-section ends 18 and two reduced cross-sections 26 to predispose the bending of member 12 along any of the bendable cross-sections as seen in FIGS. 6 and 8. Or, the food-supporting member 12 can itself be predisposed to bend between two bendable cross-section ends 18 and two reduced cross-sections 26 as seen in FIGS. 7 and 9. In either case, the food-retaining portion(s) 20 are predisposed to bend or fold having at least one reduced-cross-section 26 located tangent to an end of the bendable cross-section(s) to provide a bending bias of the portion(s) at the reduced-cross-section(s). Similar to a co-pending patent application, the reduced cross-sections can be any one or more of a variety of foldable, bendable, or hinge-like joints or seams, including but not limited to: a perforated seam, a scored seam, a perforated and scored seam, a partially cut seam, a seam having one or more apertures, a seam having a reduced height relative to the height of the food-retaining portion in which it is located, and so forth. The measure of the "reduced cross-section" can be relative to the height, or thickness, or both, of a food-retaining portion 20. In FIG. 9, a portion tab 132 is shown extending from the tip of the narrowest end an apparatus 12, and can be employed on any of the apparatus to assist a user in bending the apparatus when desired. A chief differentiator in the structure and operation of the co-pending non-provisional patent relative to the present invention, is that the former provides separable joints and the latter provides reduced-cross-section joints or seams that fold or bend. The former approach provides joints with a one-time breakaway feature of the food-retaining portion(s), and the latter provides for a bending and unbending of the food-retaining portion(s) a plurality of times.

In operation, the bending of at least one reduced-cross-section 26, or reduced cross-section joint 22, tangent to a respective bendable cross-section 16, allows a user to position at least one segment 38, or other portion, of the food-supporting member 12 downward and away from the food(s) supported on the food-supporting member to facilitate eating one or more items of food served on the multi-purpose food-serving apparatus. This approach allows food items that typically would not be easily controlled with one hand, for example, pizza served on a round paper plate, to instead, when using the present invention, be casually eaten with one hand, freeing up the other hand to hold a drink and/or napkin, or to do non-eating tasks such as talking on the phone, or writing. Similarly, the user can do many things in a stroll-as-you-eat kind of environment, such as eating the food and/or drinking a beverage with separate hands while walking in a park, amusement park, zoo, convention center, arena, mall, stadium, at the beach, and so on.

At least one food-retaining portion 20 extends upward from the food-supporting member 12 having a food-retention tab 54 that is integrally formed tangent to, and extending from, an outer end of the food-retaining portion, such as a rear food-retaining portion 24, such that the combination of the portion and the tab 54 are positionable by a user to position the tab over an upper portion of the item(s) of food. To facilitate the retention of the item(s) of food on the apparatus, a lower portion of the apparatus and an upper portion of the tab are comfortably held between at least two or more digits of a user's hand which allows the food item(s) to be pinched between the tab and a lower portion of the plate, or the plate can simply be cradled in one hand. The combined food-retaining portion and food-retention tab are preferably sized, shaped and user-positionable to facilitate the retention of the item(s) of food in a manner that allows the user to eat the served food without having to, or minimally having to, contact, or adjust, the food with his or her fingers. For example FIGS. 12 through 17 diagrammatically illustrate a method of folding a MPFSA such that a user can minimize or prevent his fingers from contacting one or more food-supporting surface of the apparatus during the use of the apparatus wherein an outermost segment 38 is bent or positioned upward relative to an adjacent second segment 38. The second segment is then bent or positioned upward relative to the bottom of the apparatus. Optionally, the apparatus can include segment attachment means whereby one or more segments is securable to the apparatus. For example, in FIGS. 12 through 14, the apparatus is equipped with at least one segment tab 84 and member slot 86 whereby the tab is sized and shaped to interlock within the slot. Alternatively, the apparatus can be equipped with suitable attachment means such as one or more adhesive seal 88 that optionally is coverable by a user-removable peel-off seal (not shown) whereby the seal is sized and shaped on a lower surface of one or more segment 38 to adhere to a bottom surface of the apparatus. FIGS. 15–17 show an optional interlocking action between a segment tab and segment slot. FIGS. 15–17 also show an optional rounded contour of a rear food-retaining portion 24 wherein the portion is pre-curved or ribbed with bendable cross-sections 16 to facilitate curving of the portion by a user.

FIGS. 12 through 17, illustrate how the MPFSA 10 is foldable to substantially minimize or prevent contact of the food-supporting surface 14 of the apparatus with a user's fingers and can optionally include instructional material printed on the apparatus to inform the user how to fold and/or use the apparatus for such purposes. Additionally, at least one food-supporting member segment 38 can be equipped with a quick-fastening means 82 for positioning and retaining at least one folded segment of the apparatus a.) away from food that is about to be eaten by a user, and b.) adjacent to a surface of the food-supporting member 12. In one instance, the quick-fastening means 82 consists of at least one food-supporting member segment 38 having at least one segment tab 84 that is sized and shaped to interfit within at least one member slot 86 located within at least one food-supporting member, such that when a segment(s) of the member is positioned by a user, the tab(s) is extendable therefrom for engagement into the (slot(s), to retain the segment(s) proximate to a lower surface of the member. The tab(s) can also have at least one boundary having a reduced-cross-section to allow a user to separate the boundary from the food-supporting member and insert a portion of the tab(s) into the slot(s). In another instance, the quick-fastening means can be comprised of at least one adhesive seal 88, or an adhesive seal with peel-off material 90 that can be removed by a user, wherein the adhesive material is suitable sized and shaped to readily adhere to a surface of at least one food-supporting member. The quick-fastening means can also be a hook-and-loop material 92 wherein at least one food-supporting member surface has a hook material adjoined thereto suitably sized and shaped to readily adhere to a food-supporting member surface having a similarly sized and shaped loop material adjoined thereto.

Alternatively, one or more surface of the apparatus can have a plurality or a multiplicity of bendable cross-sections to provide a user-selectable bending of one or more apparatus surface at a multiplicity of bendable cross-sections. For example a food-supporting member 12, or a rearmost food-retaining portion 24, or the combination of a rearmost food-retaining portion 24 and a food-retention tab 54, can be made with a plurality, or a multiplicity of, bendable cross-sections that are predisposed to bend along a reduced-cross-section, which allows the user to shape the member 12, or portion 24, or combination portion 24 and tab 54, 1.) to accommodate different thickness of food such as pizza slices having crusts with different thickness, or 2.) in a rounded manner, similar to the curved cover of a roll-top desk. Alternatively, a rearmost food-retaining portion 24, or the combination of a rearmost food-retaining portion 24 and a food-retention tab 54 can be made of any one or more in a variety of flexible materials, including the option of being a material different from the rest of the apparatus but adjoined thereto, which, in either case, easily conforms to the shape of a portion of the served food-item(s) to facilitate an easy clasping thereof. An end of the flexible material(s) is attachable to an end the apparatus using any one or more in a variety of common and suitable attachment means, including but not limited to, the use of one or more: adhesives, fasteners, heat seals, and so forth. The flexible material(s) can comprise material such as flexible: paper, plastic, rubber or rubberized material, metal foil, fabric, coated fabric, coated paper, thin cardstock, thin coated cardstock, laminated material, and the like. Alternatively, the flexible material can be comprised of the same material as the rest of the apparatus, but having gone through a process which removes stiffness from just the area of the material used for clasping the food-item(s). In the latter case, the stiffness of the material can be reduced by going through series of rapid creasing and uncreasing cycles (for example a plurality of cycles using a different embossing die), or can be punctured with a multiplicity of apertures. Alternatively, the intended reduced stiffness area can be subjected to one or more chemical treatments known to produce reduced stiffness in the subject material.

Thus, a view-as-you-eat and/or folds-as-you-eat multi-purpose food-serving apparatus is provided which is substantially sized and shaped to the size, area and perimeter of at least one item of food intended to be served thereon, comprising a food-supporting member 12 consisting of a material sized, and having sufficient rigidity, to serve and support the food-item(s) thereon. The food-supporting member 12 has at least one food-retaining portion 24 integrally formed adjacent thereto which extends upward, relative to a food-supporting surface of the member, in a manner which increases the rigidity of the food-supporting member. The portion(s) 24 is sized, having sufficient rigidity, to facilitate the retention of the item(s) of food on the food-supporting member. Extending across the food-supporting member is at least one bendable cross-section, and the food-retaining portion(s) has at least one reduced-cross-section located tangent to an end of the bendable cross-section(s) to predispose bending of the portion(s) at the reduced-cross-section(s).

The combination of the food-supporting member and food-retaining portion(s) provide:

i. an apparatus rigidity sufficient to support food-item(s) when the apparatus is held at one end by a user, and ii. an apparatus pliability which accommodates the bending and unbending of the apparatus a plurality of times; whereby the bending of at least one reduced-cross-section tangent to a respective bendable cross-section, allows a user to selectively bend at least one segment of the food-supporting member away from the food-items(s) supported on the food-supporting member in a manner that does not significantly alter the presentation of the food, and fully exposes a portion of the food-item(s) to facilitate the eating of the exposed food portion.

At least one surface area of the apparatus can be further comprised of observer-discernible and/or user-discernible content including, but not limited to one or more coupons 60, or prize announcements 62 or other advertising content. When the content consists of one or more coupons or prize announcements, at least one border of the coupon(s), or prize announcement(s) can optionally have a reduced cross-section to facilitate its removal from the apparatus. For example, at least one boundary of at least one portion of the coupon(s), or prize announcement(s), can be perforated, or partially cut, to facilitate its removal by a user. The coupon 60, or prize announcement 62 can be temporarily covered by a scratch-off material 78, or a peel-off material 90 that can easily be removed by a user to reveal user-discernable content beneath either of such material, or on the removable material itself. The observer and/or user discernible content, including one or more coupons 60, or prize announcements 62, can be located on any surface of the apparatus or any lid or cover thereof, including areas wherein the content is:

1.) positionable into the field of view of a user when a user is, a.) about to take a bite out of the item(s) of food supported by the apparatus, or b.) when a user is taking a bite out of the item(s) of food supported by the apparatus;

2.) located on the apparatus such that it is revealed to a user after one or more portions of food that was covering the content has been eaten;

3.) viewable when the apparatus is held by a user; or

4.) viewable when the apparatus is placed in a resting position.

The MPFSA is preferably comprised of material having a pliability that accommodates an instant user-reshaping of a user-bent apparatus, to a substantially unbent previous condition, to facilitate the quick setting down of the apparatus in a resting position, as needed. Conversely, MPFSA pliability provides an instant reshaping of a user-unbent apparatus by the user, when picked up by the user from a resting position, to a previous bent condition.

One or more of the multi-purpose food-serving apparatus in part, or in their entirety, is/are configurable into, and useable by a user for one or more of a variety of other purposes, wherein content printed, or otherwise appearing, on at least one surface of the apparatus has a particular appearance. In FIGS. 32 through 35 the apparatus has the shape and appearance of a triangular shaped flag 190 or pennant 188, and the apparatus 10 is easily configurable into and employed by a user in a manner typical of a flag or pennant. The flag or pennant can be printed to replicate any well-known actual flag or pennant or one or more portions thereof. The flag or pennant variant of the apparatus preferably has one or more slot 182 formed therein, through which, a user can insert a flag or pennant elongated support member 180 such as a stick, or tube, or dowel, or straw, and the like. Alternatively, as shown in FIG. 32 an end of the apparatus can be folded and sealed in a manner that creates a passageway through which an elongated support member 180, or a string, or rope, or thread, or line, can be inserted. FIGS. 34 and 35 illustrate a streamer cord 192 supporting a plurality of pennants each promoting at least one sports team, or same-colored, or different-colored, or multi-colored flags, strung and suspended from a common line in a stringer-like fashion.

Another of the multi-purposes of the present invention is to provide a MPFSA 10 having at least one exhibiting means 36 wherein at least one side area of the apparatus, or segment(s) 38 thereof, or tab 54, or one or more food-retaining portions 20 or one or more sides thereof, or one or more sides of the food-supporting member 12, or one or more combinations of such apparatus parts, are positionable in close proximity into the field of view of a user, to serve, in effect, as a small-scale billboard viewable to a user when, a.) the user is holding the apparatus in one or both hands, b.) the user is about to take a bite out of the item(s) of food supported by the apparatus, c.) when the user is taking a bite out of the item(s) of food, supported by the apparatus. In FIG. 1, an end of an apparatus 10 is positioned by a user close to her mouth such that her field of view, indicated in dashed lines, comfortably takes in a majority of the apparatus' upper surfaces. FIG. 1 further illustrates that exhibiting means 36 are viewable on an upper surface of food-retaining tab 54 in close proximity to the user as she is about to eat, and as she eats, the food served on the apparatus. It can also be seen how food can be stabilized between a lower surface of tab 54 and a food-supporting surface of apparatus 10 when a user holds those surfaces between at least two digits of a hand. In FIG. 2, a user uses a hand closest to her mouth to bend, or position, a segment 38 of the MPFSA 10 downward relative to the food item(s) 28 being served and thereby exposes optional exhibiting means 36 on a food-supporting surface of the MPFSA 10. Optionally, exhibiting means 36 can also be included on the underside of apparatus to display observer-discernable content(s) to people near the user as the user bends one or more segments 38 away from the food. FIGS. 1 and 2 further illustrate that user-discernable content(s) hidden under food item(s) 28 will be revealed in the field of view of the user as she eats more of the food item(s). In each case, such content(s) is held in the field of view of the user during the several minutes it takes to eat the served food.

FIG. 3 compares and contrasts the size of advertising, or promotional, or cross-promotional, or user-discernable, content, and the like, that can be exhibited on a food-retaining tab 54 relative to the size of a screen-wide website banner 196 as seen at a comfortable viewpoint by a user seated before a large computer monitor 194. When the multi-purpose food-serving apparatus 'MPFSA' is positioned near the mouth of the user, the size of tab 54 is substantially the same relative size as the website banner, i.e. the banner width 198, and the banner height 200 are about that of a width of a slice cut from a 16" pizza. The tab 54 and content thereon, is positionable right-side up in close proximity into the field of view of the user, and the relative size of the tab when a user is eating, or about to eat, served food on the apparatus, is also comparable to that of a billboard seen from a vehicle.

In contrast to the content appearing on the outside of a beverage cup, or hamburger or sandwich wrapper, the content of the exhibiting means of the present invention is positionable right-side up in close proximity to the user's field of view and is viewable at a comfortable distance, as food on the apparatus is about to be eaten and while food is being eaten. While it could be possible to include some of the aforementioned content and/or indicia on the lid of a beverage cup or can, the typical exposure time to a beverage lid is a mere fraction of the multi-minute exposure for the several minutes needed to consume the food-item(s) supported by the MPFSA. Beverage drinking is often also done in sporadic brief sips. Furthermore, the apparatus of the present invention facilitates a comfortable means for supporting the food and eating the food, and in many cases allows a user to comfortably support the served food for several minutes with just one hand, during which time, the tab of the apparatus, is in plain view of the user and of those in close proximity to the user. Tab 54, and other apparatus surface(s), are also in plane view of a user and/or others when the apparatus is set down in a resting position.

In reference to the illustrations and depictions in FIGS. 1 through 3 and the remaining figures, it is to be noted that in many instances it could prove advantageous to have any one or more of a variety of the types of surfaces and/or content(s) mentioned above. These types of surfaces and content(s) include, but are not limited to any one or more of the following: user-discernable content 32; observer-discernable content 34; exhibiting means 36; segment 38; indicia 42; printed content 44; Braille content; embossed content 46; die-cut content 48; food-retention tab 54; promotional announcement 56; cross-promotional announcement 58; coupon 60; prize announcement 62; menu contents; organization name 64; learning institution name 66; logo; event announcement; holiday-related content, and segment coupon 68 (wherein an entire segment is removable and redeemable as a coupon). It is noted that although these types of content are specifically depicted in reference to FIGS. 3, 10, 28, 30, 31, that any one or more of them may alternatively appear on, or be displayed on, any other apparatus 10 or side(s), or surface(s), thereof. When a plurality of such content appears on a MPFSA 10, the content can be same-sized or be variably sized. An example of the latter is shown in FIGS. 6 through 8 wherein indicia, logos, and removable coupons respectively, are variably-sized.

Thus, one of the multi-purpose functions of MPFSA is to provide a new type of advertising medium, or promotional medium, wherein millions of hours of cumulative exposures per week can be achieved by makers of particular types of food. For example, some pizza chains sell tens of millions of slices of pizza per week. A typical large slice of pizza takes about five minutes to eat, and the average number of slices eaten are about 2–3 slices per person (ten to fifteen minutes per person). Therefore, every ten million slices of pizza served on a MPFSA represents a potential exposure of 50 million minutes wherein a user is holding the tab 54 in close proximity to his or her field of view, and/or holding, or setting down, the apparatus in plain view of others nearby. Thus, a pizza chain selling 40 million slices a week could attain up to 40 million, 5 minute exposures equaling 200 million minutes, or over 3 million hours of advertising, or promotion, or cross-promotion, and the like, per week. For example, one or more surface of the MPFSA such as the upper surface area of tab 54, can be employed as a close proximity exhibiting means 36 having any one or more of a variety of discernable content thereon, including but not limited to: indicia, text, printed matter, Braille content, graphical content, photographic content, and the like, and the tab can optionally be embossed, or die-cut. Such content includes, but is not limited to, any one or more of the following types of content/information or subject matter: advertisement(s), promotional announcement(s), cross-promotional announcement(s), event announcement(s) and/or information, removable coupon(s), prize announcement(s), holiday-related content(s), party-related subject matter, celebration-related subject matter, organization name(s), learning institution name(s), sports team name(s), famous or well-known person name(s) and/or autograph(s), name of a well-known engine-powered vehicle such as a race car, plane, jet, boat and the like, the name of a travel-related facility, the name of a facility employed for sports-related activities, the name of a recreational facility or amusement park, subject matter pertaining to at least one event that will be attended by a large audience, photographic or graphical representation(s) of the food being served on an apparatus, and so forth. Other content can include an apparatus code that a user can enter into a data-entry field at a website, or enter into a data-entry field at a website to enter a contest, or a code that a user can enter into a data-entry field of a software application. The content code can be readable by an optical scanning device, or a removable mail-in code.

In the case of one or more cross-promotional announcements, the content(s) appearing on MPFSA 10 can promote things other than the food or name of the company providing the food being served on the apparatus, such as a beverage and may optionally include a discount coupon for the beverage. Alternatively, a cross-promotional announcement can promote a non-food entity such as a feature film or event. Promotional announcements include, but are not limited to one or more large-audience: events, shows, concerts, performances, venues, stadiums, arenas, amusement parks, races, sports event, and the like.

Thus, a food-serving apparatus exhibiting means 36 is provided whereby a substantial amount of cumulative advertising, or promotional, or cross-promotional, information, and the like can be offered both in public and private settings. It is to be noted that in several embodiments of the present invention, that a previous folding, or bending, or shaping, or positioning, of one or more part of the food-supporting member of the apparatus by a user, is easily reshaped to an unfolded, or unbent, or unshaped, or unpositioned, to its former condition by the user. In many instances the apparatus regains much of its original shape by simply resting the apparatus on a flat surface. Additionally, at any point in its use, a user may re-crease original folds of the apparatus, and/or flatten any bent bendable cross-sections thereof, to regain much of the apparatus' original food-supporting rigidity. Thus, a once-bent MPFSA is easily made re-useable to support more food items and to eat subsequent served food with the advantages and features offered by a new apparatus. When the apparatus is made out of some materials commonly used for a food-serving apparatus it can be bent and unbent dozens of times.

As previously described, user-discernable content and/or observer-discernable content can be included on one or more surface area and/or one or more sides of apparatus 10, or food-supporting member 12, or food-supporting surface 14, or food-retaining portion 20, or food-retention tab 54, or one or more combined surfaces thereof, and can be: perforated, or printed, or printed and embossed, or printed and die-cut, or printed, or embossed, or Braille embossed, or die-cut, or any combination thereof. In each case, a multi-purpose food-serving apparatus having at least one exhibiting means is provided.

Alternatively, any one or more of a variety of surfaces, or materials, can be employed to exhibit user-discernable content and/or observer-discernable content, including full or partial surfaces surface areas and/or materials, that are transparent, or translucent, or opaque, or comprised of reflective material, or holographic material, or temperature-sensing material that changes appearance to indicate one or more temperature of an apparatus-served food item, or a pixelated material, or electrically powered LCD material, and the like.

Figure 4:
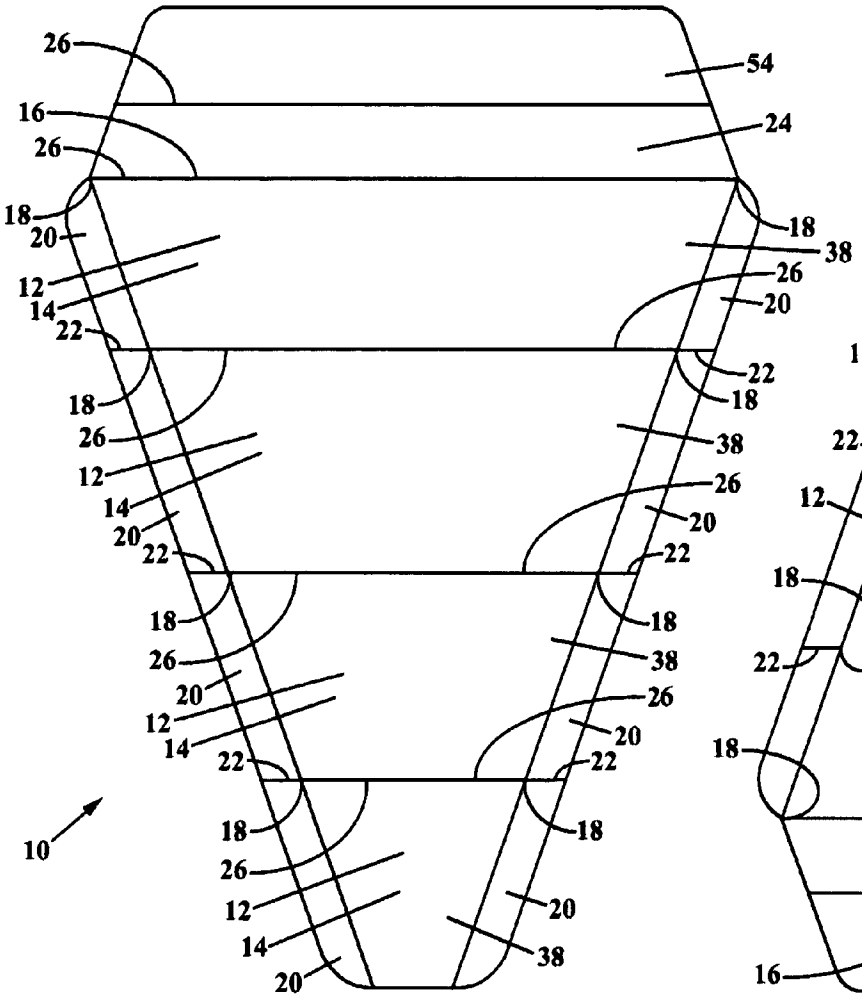

In reference to FIGS. 4 through 9, top views of MPFSA are shown before it is three-dimensionally shaped into a food-serving configuration. In each of these figures, the apparatus 10 is comprised of a food-supporting member 12 having a bendable cross-section 16, a bendable cross-section end 18, a food-supporting surface 14, food-retaining portions 20, and a rear food-retaining portion 24 from which extends a food-retaining tab 54. The food-retaining portions 20 and 24, are positionable during manufacturing or fabrication of the apparatus, and/or subsequently by a user, such that when the portions 20 and 24 are positioned upward relative to the food-supporting member 12, the rigidity of member 12 and the strength of one or more bendable cross-sections 16 are increased. In FIG. 4, bendable cross-sections 16 extend across the food-supporting member 12 as printed fold lines, or as reduced cross-sections 26 that are scored and/or perforated. In FIG. 5, the food-supporting member 12 is not printed or predisposed to bend along a particular cross-section but can bend tangent to one or more optional food-retaining portion joints 22. In FIGS. 6 through 8 one or more surfaces of a variant of the apparatus exhibits any one or more of a variety of user-discernable content 32 and observer-discernable content 34 and/or various-sized content, including, indicia, printed matter, Braille content, die-cut, embossed, content and the like, optionally including one or more of the following: corporate or organizational logos, coupons(s) 60; prize announcement(s) 62, and the like. In FIG. 9, the reduced-cross-sections of the food-retaining portions are reduced in height rather than in thickness. Additionally, it is noted that any one or more of the foregoing content(s) can be positioned on the apparatus in a manner that reduces, minimizes, or eliminates, their contact with the served food item(s). For example, in FIG. 8, a coupon 60, or prize announcement 62, is shown positioned on the right end of rear food-retaining portion 24, and similarly, could be positioned on the left end of portion 24 as well, such that, when the apparatus is serving a slice of pizza, the apex of the arced crust contacts only the center of portion 24 and not either end. Thus, the user-discernible and observer-discernible content positioned on the apparatus is positioned substantially out of contact with served food-items.

FIG. 10 is a rear view of a MPFSA illustrating that a rear food-retaining portion 24 and/or one or more lower surfaces of positionable segments are employable as exhibiting means upon which user-discernable and/or observer-discernable content can be displayed, such as any one or more of the content(s) described above. In operation, one or more of segments 38 are positioned downward by a user from food supported on the upper surface of food-supporting member 12 such that any content(s) appearing on the bottom surface of any of segments 38 is then viewable by people nearby.

FIG. 11 depicts a MPFSA design template of the type that can be stored as a computer file and accessed by one or more users from a computer-record storing medium or apparatus, or downloaded from a user-accessible computer network, for example, a website, or FTP site. Alternatively, one or more template file can be can be mailed or emailed to users. In operation, the design of apparatus content that can be used on an apparatus is designed and submitted by individuals who first, load an apparatus template file into a computer-design application and create a desired appearance, or print out the file, color or draw on it, and scan that edited work using a computer scanner. Each finalized design is then saved and can be uploaded, emailed or mailed to a maker of the apparatus. It is to be noted that the methods of having a user receive one or more mailed template file, or retrieve a file template from a website, for the purpose of designing one or more apparatus, provides a means for the maker of the apparatus to host design contests, and in the case of website file communication, to substantially increase the number of user visits to the maker's website. Contest advertisements, prizes and awards can be employed to incentivize user downloads of blank file templates and uploads of user-designed file templates. To further increase website visitations, participants can visit the website to place votes for the best designs, including voting for best designs locally, regionally, nationally and internationally. Contests can include the best designs for any of the multi-purpose applications of the apparatus including, but not limited to the best: plate or tray, display, wearable item, visor, lamp shade, hat flyable airplane or spacecraft, flag, pennant, or sail. Contests can also include sports themes, seasonal and holiday themes, party themes, picnic themes, and the like, such as: Olympics, Superbowl, NFL, Indy 500, NASCAR, New Year's, Valentine's Day, St. Patrick's Day, $4^{th}$ of July, Thanksgiving, Chanukah, Christmas.

Similarly, one or more printouts of file templates can be mailed or otherwise distributed to contestants and their finished designs can simply be mailed to an apparatus maker. Such distribution can include one or more blank templates in, or with, the packaging containing a particular type of food. For example, the printed template(s) can be placed in, or on, a pizza box, or in a bag therein or thereon. Blank templates, whether simply printed, or used in a computer application, can have one or more purposes. In some computer applications it is also possible to include templates having more than one layer, wherein each layer is a variant of the apparatus intended for a particular purpose, e.g. one layer is a plate template, another layer an airplane template, and so forth. In each case, one or more designs can be facilitated by a template. In FIG. 11, the template layout is dual-purposed and can be used to design a plate and/or a flyable toy airplane preferably with markings and/or instructions to indicate the wings and one or more bending paths that will be used to create the plate and/or airplane.

When a website is used to facilitate contestant participation, the website can promote currently available, and upcoming apparatus designs that will soon be available, and/or upcoming contests. For example, a series of plates, or aircraft, or sailing toys, or flags, or pennants, or holiday-themed, or party-themed apparatus, can be shown that are or will be available either on the website or available at outlets owned or operated by the apparatus maker(s).

Other plate and display designs, whether designed by users, or designed by designers of the apparatus maker's choosing, can include designs for one or more: themed parties, birthday parties, surprise parties, school reunions, company or organization gatherings or picnics, family picnics, and so forth.

In other embodiments of the present invention, the multi-purpose food-serving apparatus 'MPFSA' in its entirety, is configurable into, and useable by a user as, for recreational purposes, or as one or more recreational toys, or one or more wearable items, or one or more displays. In each case, the apparatus preferably includes instructions and/or indicia to facilitate configuring and/or using the multi-purpose apparatus for any one or more of such purposes. Indicia on the apparatus include but are not limited to any one or more of a variety of one-sided or two-sided printed lines, scores or perforations indicating where a user should fold and/or bend the apparatus to achieve a particular outcome. For example, content printed on at least one surface of the apparatus can be provided having the appearance of an aircraft, spacecraft, or rocket, wherein the apparatus is also easily foldable into a toy aircraft, spacecraft, or rocket, by a user. Toy aircraft can optionally have the likeness of aircraft appearing in a particular air show. Alternatively, the apparatus can have the appearance of a whole or partial sail, or the appearance of a portion of a tetherable kite, wherein one apparatus is configurable by a user into, or a plurality of the apparatus are adjoined as previously described by a user with at least one adjoining means to form, a toy sail, or a tetherable kite, by a user. The whole or partial sail can have one or more die-cut slots through which a user can insert a toy mast to mount the sail on either a water-sailing toy, or a land-sailing toy having wheels. The tetherable kite is preferably comprised of a plurality of apparatus adjoined to one another by suitable attachment means such as glue, or adhesive tape, or fastening means such as staples, and the like.

In wearable item embodiments, the multi-purpose food-serving apparatus 10 can include printed instructions in the language of an intended user for instructing a user how to configure the apparatus into, and/or how to use the apparatus as, at least one type of wearable item. Several types of wearable apparel can be achieved. In one instance, the apparatus can have the appearance of a hat and be comprised of a plurality of apparatus adjoined to one another by suitable attachment means such as staples, or tape, or glue and can be secured to a user's head by a string, or lace, or ribbon, or elastic material, and the like. The apparatus can also have the appearance of the bill of a hat, wherein the apparatus is foldable into the bill of a hat by a user and the bill is securable to the user's forehead using suitable attachment means. Alternatively, as illustrated in FIGS. 28 through 30, the MPFSA 10 can have the appearance of a visor 120, wherein the apparatus is foldable into a wearable visor by a user, and the visor is securable to the user's forehead using suitable attachment means 80 such as those previously described for securing a hat to a user's forehead. The visor bill 122 and forehead-fitting member 124 can be equipped with interlocking means such as a separable member edge 126 of an arced member tab 128 formed in a rearmost segment 38 of the food-supporting member of the apparatus, and a separable portion edge 130 of at least one portion tab 132 formed in a rearmost food-retaining portion of the apparatus, wherein a separation of the edge of the member tab allows the bending of the food-retaining portion around the contour of a user's forehead, and a separation of an edge and bending forward of the portion tab(s) secures the food-supporting member of the apparatus in a visor-bill like fashion. Additionally, the visor can be configured from a food-supporting member 12 having a plurality of segments 38 adjoined by at least one reduced cross-section 26 spanning the width of the food-supporting member 12, such that a separation of at least one segment at a reduced cross-section permits a user to selectively choose a desired length of the visor-bill.

In reference to FIG. 31, a MPFSA is shown in a resting position, illustrating the apparatus having one or more surfaces upon which user-discernable and/or observer-discernable content can be displayed, such as any one or more of the contents previously described.

In other wearable embodiments of the MPFSA, the apparatus can have the appearance of a portion of a women's two-piece bathing suit top and the like, wherein one triangular-shaped apparatus or a likeness thereof, or a fabric representation thereof, is employed for a left half of the bathing suit top and is sized to cover the left breast of a female user, and a second triangular-shaped apparatus or a likeness thereof, or a fabric representation thereof, is employed for the right half of the top of the bathing suit and is sized to cover the right breast of a female user. One or more segments of the apparatus are foldable and securable around an attachment means to secure the apparatus to a female body, such as the attachment means previously described, or those typically used to attach a bathing suit to woman. For example, the apparatus, or a likeness thereof, or a fabric representation thereof, can be positioned so that its narrow end (when the apparatus is triangular) is generally pointing upward, and its opposite side (base) is generally pointing downward, such that, a bendable segment nearest the tip end of the apparatus can be folded over and secured by suitable attachment means around a lace or strap that would then secure the top around the neck, or over the shoulder of a female user in a conventional manner, and a bendable segment nearest the opposite end (base) of the apparatus can be folded over and secured by suitable attachment means around a lace or strap to secure the apparatus to a torso of a female user in a conventional manner. Similarly, the apparatus can have the appearance of a portion of a women's two-piece bathing suit bottom, wherein the one triangular-shaped apparatus is employed for a front half of the bathing bottom, and a second triangular-shaped apparatus is employed for a for a rear half of the bathing suit bottom. One or more segments of the apparatus are foldable and securable around an attachment means to secure the apparatus to a female body, such as the attachment means previously described. In another wearable embodiment, the apparatus is configurable into temporary sandals such as a type that can be used temporarily to walk on the hot sand of a beach, in which case the apparatus is secured to the bottom of a user's feet using suitable attachment means such as a string, or lace, or ribbon, or strap, or elastic material, and the like.

In FIGS. 24 through 27 one or more of the MPFSA in their entirety, is configurable into, and useable by a user as one in a variety of self-supporting displays such as self-standing, or wall-mounted, or window-mounted, or lamp shade, displays. In FIG. 27, content printed on at least one surface of the apparatus has the appearance of a portion of a lamp shade, tent, teepee, or self-standing display, wherein a plurality of the apparatus are configurable by a user into a lamp shade, tent, teepee, or self-standing display, by adjoining at least one edge of each of the plurality of apparatus to at least one other edge of an adjacent apparatus using suitable attachment means such as glue, adhesive tape, or quick-fastening means such as one or more staples, and the like. A single apparatus is also configurable by a user into: 1.) a display with attachment means such that one or more surfaces of the apparatus is equipped with an adhesive material, or suction cup(s), to attach an apparatus to a flat surface such as a wall or window, 2.) a display with attachment means such as a aperture, or slot, or cut-out portion, to provide an opening to hang the apparatus on a peg, or hook, or nail. or doorknob 3.) a display by bending a food-retaining portion adjacent to the food-supporting member of the apparatus to angle less than 90 degrees and standing the apparatus on a side of that portion. To positively position the single apparatus in an upright position as seen in FIGS. 24 and 25, a surface area of the apparatus preferably has display attachment means 162 and/or one or more added display weight 160, for securing the apparatus to a display exhibiting surface. The single apparatus, or multi-apparatus displays can also be backlit by employing suitable lighting means, and whether backlit or not, can have advertising, promotional, cross-promotional, coupon, or prize announcement, content, and the like, printed on one or more surface of the apparatus. For example, one or more apparatus or portion(s) thereof, can promote a feature film, or have the appearance of a Christmas tree, or content pertaining to another holiday, or portray the likeness of at least one famous person. The apparatus, or one or more portions thereof, is comprised of transparent, or translucent, or opaque, or foldable, or bio-degradable material, or micro-wave-tolerable, or oven temperature-tolerable, or any combination thereof.

Some novelty variants of the present invention are also provided, wherein the apparatus has the appearance of the beak of a bird and is employable as the bill of a hat or visor and is attachable to a user's head as previously described. Or, the apparatus has the appearance of at least one ice-cycle or tooth, and one or more of such apparatus is employed as an exhibiting means to display that appearance. For example, a plurality of apparatus can be suspended from a common line in a stringer-like fashion as previously described, to give the appearance of a plurality of ice-cycles, or in the case of a plurality of teeth, the appearance of a large smile. In other recreational embodiments, at least one of the multi-purpose food-serving apparatus is configurable by a user into a fan, or alternatively can be made into a noise-maker. In the case of a fan, at least one edge of each of a plurality of the apparatus are adjoined to at least one other edge of an adjacent apparatus by suitable attachment means, such as those previously described. In the case of a noise-maker, a plurality of the apparatus are configurable as seen in FIG. 26 by a user a.) for example, aligning two apparatus together and adjoining all but one of the sides thereof using suitable sealing or attachment means, b.) conveying a multiplicity of small hard elements such as one or more food grain, or small pellets or bee bees, through an opening between the yet-to-be sealed side, and then c.) sealing the open side.

As previously mentioned, one or more surface area of the apparatus can exhibit any one or more of a variety of user-discernable and/or observer-discernable content including: indicia, text, graphic, photographic, holographic, temperature sensing and indicating material, and/or electrically displayable content, and the like. When any of such content is located on one or more segment 38 of the food-supporting surface 14 of food-supporting member 12, the multi-purpose food-serving apparatus 10 serves as a means to gradually reveal such content in close proximity to a user, and to those proximate to the user, as the user gradually eats one or more items of food served on the apparatus. Thus, content such as the advertising, or promotional, or cross-promotional, or coupon, or prize announcement, and the like, previously mentioned can be located on one or more segment 38 and is successively revealable as food previously covering a segment 38 is eaten, and the content can also be different in size, or scale, from one segment to the next. Additionally, user-discernable and/or observer-discernable content on the bottom of a MPFSA, such as one or more company logo, or brand name, and the like, can easily be seen by observers nearby a user when at least one segment 38, portion of the food-supporting surface 14, is positioned downward by a user relative to a unbent portion of the food-supporting surface. Indicia, or printed instructional material in the language of an intended user, can be included on an apparatus for indicating to a user how the apparatus is to be positioned, or shaped, or bent, and/or used, in order to position at least one positionable segment of the apparatus away from food that is about to eaten by the user, and facilitate successive biting of the served food.

The MPFSA 10 is configurable, either partially, or in its entirety, into one or more recreational toys and can include instructional printed content thereon to inform a user how to configure the apparatus into, and/or use the apparatus as, a particular toy. In FIGS. 18 through 23, the toy is a flyable airplane 94 and is configured into the airplane by a user folding the apparatus. The flyable airplane can include at least one weight adjoined thereto, or at least one weight mark 96, indicating where at least one weight can be added to the apparatus to provide an optimal center of gravity of the airplane. The weight can consist of at least one specified coin 98, for example one, or two, pennies, or other specified weight. Alternatively, as shown in FIGS. 22 and 23, the weight can consist of an attachable nose piece 100 made of a resilient material having a weight sufficient to provide the optimal center of gravity, wherein the nose piece is attached to the flyable airplane with suitable attachment means, such as glue, or adhesive tape, or one or more staples, and the like. The attachable nose piece can also be equipped with at least one weight aperture 102, or coin-sized aperture 104, to secure a pre-determined weight, or at least one coin, therein such that the nose piece and the weight(s) or coin(s) have a combined weight providing the optimal center of gravity. Alternatively, the attachable nose is attachable to the flyable airplane by a friction fit between at least one airplane leading edge 106 and at least one leading edge receiving slot 108 formed in the nose piece, whereby a friction fit insertion of the leading edge(s) into the receiving slot(s) secures the nose piece to the airplane in a manner that retains the airplane in an optimally folded condition. When one or more coin 98 is employed as an airplane weight, the coin is adjoined to part of the airplane using adjoining means such as glue, or adhesive tape, and the like, to provide the optimal center of gravity.

Indicia, and/or instructional material for configuring and/or using one or more apparatus recreationally can include any one or more of the following: at least one printed fold line 110 to facilitate a folding of the apparatus along the fold line(s); at least one reduced cross-section 26 such as a perforated seam, or a scored seam, or a scored and perforated seam, to facilitate a folding of the apparatus along the reduced cross-section(s); and the like, or any combination thereof.

In reference to FIGS. 36 and 37, variants of the MPFSA are seen that are employable, either in part, or their entirety, as a sailable toy, and the sailable toy has one or more surfaces upon which user-discernable and/or observer-discernable content can optionally be displayed, such as any one or more of the contents referred to above. In FIG. 36, the sailable toy is a water sailing toy 170, in FIG. 37, the sailable toy is a land-sailing toy 172 with wheels. In each case the apparatus 10 can have indicia to indicate where a user can cut the apparatus to make one or more slots to accept the insertion of a sailing toy mast 174, or the apparatus can have one or more slots die-cut therein to receive a mast 174. Optionally, either toy can also include one or more slotted sail guides 178 wherein a lower edge of an apparatus can be fitted into a slot of the guide 178 to set the sail of the toy in a desired manner.

As previously mentioned, the MPFSA 10 can be made in various sizes and shapes and preferably the size and shape of each apparatus is optimally and ecologically-sized to be approximately the same size and substantially the same shape as at least one item of food intended to be served thereon, thus requiring a minimum amount of the material. For example, when a triangular-shaped slice of food or dessert such as a pizza slice or pie slice, is intended to be served on an apparatus, the shape of the apparatus provided can also be triangular in shape. Or, when a rectangular-shaped slice of pie or pizza is intended to be served on an apparatus, the shape of the apparatus provided can also be rectangular in shape, and so forth with round-shaped, elliptical-shaped, and odd-shaped food items. In each case, whether the food-supporting member of an apparatus 10, is triangular, or rectangular, or round, or elliptical, random-shaped, odd-shaped, and so forth, the apparatus provides at least one bendable cross-section 16 located between a plurality of segments 38 of a food-supporting member and the apparatus optionally provides the food-retention tab and/or exhibiting means and user-discernable and/or observer-discernable content, as previously described. Additionally, any one or more of the various sized and shaped apparatus can be made with an adjoining clamshell top 142, or a separate matching top 144, or lid 146, and each top can optionally be configured with at least one tab to interlock with at least one slot located on the apparatus.

In FIGS. 38 through 43, embodiments of the apparatus are shown for use in the food-service industry, or for use in the packaging of convenience foods, or frozen foods, or desserts, or added-value foods, and the like, and in particular are tailored to the needs of customers frequenting businesses that provide convenience foods for 'Grab & Go', or 'Drive-Thru' customers. In FIGS. 38 and 39, the MPFSA has an attachable lid 146 that optionally includes a napkin cavity 212, or pocket (not shown), into which one or more apparatus-accompanying napkin(s) 208 can be secured by a napkin-securing means 152, such as an elastic member, or clip member, or snap fit member that spans the napkin(s) having opposite ends that engage the lid until the member is removed by a user, and/or the attachment means can include an adhesive material that holds the napkin in place until the napkin is removed by a user. The napkin(s) is preferably substantially sized and shaped to the size and shape of an upper region of the lid. Alternatively, an adhesive material on one or more surface area of the lid, can be employed to secure the napkin(s), or an elastic material can secures the napkin(s) in the napkin cavity by surrounding the cavity, the lid and optionally also surrounds the apparatus. It is noted that although the napkin cavity 212 is shown on an upper side of attachable lid 146, the cavity can instead be located in an upper inside region of the lid, and one or more of the above-mentioned attachment means can be employed to secure the napkin(s) in the upper inside region. The lid 146 has one or more extended tab(s) 158 to interfit in a respective slot 150 located in a lower region of the apparatus 10. In operation, the attachable lid is lowered down over one or more food items and the tab(s) 158 is inserted in the respective slot(s) 150. Optionally, the lid 146 can have a rearward-facing slot 156 into which a portion of a food-retention tab 54 can be inserted to further secure the lid to an apparatus. It is noted that although the attachable lid 146 is shown as a separate component, that it can instead be provided in a clamshell lid configuration wherein, an upper portion of the clamshell lid can optionally be removable, for example by a user tearing the lid off at a perforated reduced cross-section, in which case the removal of the lid from the apparatus allows the apparatus to function as previously described. In either case, the lid is preferably comprised of material having suitable rigidity to allow numerous lid-covered apparatus of the same size to be stacked on top of one another. As needed, the MPFSA, and as necessary its outer wrap, is/are made of material suitable for one or more of the following purposes, refrigerating food, freezing food, or heating food in a conventional oven, or a microwave oven, or other heating device.

FIGS. 40 and 41 are three-dimensional views depicting a variant of a multi-purpose food-serving apparatus having a clamshell configuration including an upper lid portion extending forward from the front edge of the upper tab of the tray. The lid portion is attached to the tab at a reduced cross-section such as a perforation and/or score which facilitates a tear off utility allowing the user to easily remove the lid portion from the tab. In FIG. 41, the tray and lid portion are shown sealed within a protective wrap. The tear off lid portion can optionally include one or more side walls, including walls with slots and/or tabs such as those depicted in FIGS. 38 and 39. The MPFSA 10 has an upper segment 38 and detachable top covering 228, which is removable at perforated seam 230 by a user to allow apparatus user-operation and/or heating-operations as previously described. The embodiment provides an apparatus wrapper 210 to facilitate food-service operations, stacking, food refrigeration or freezing, or food heating, and is removable by a user when desired. When needed, the wrapper is preferably comprised of material suitable for heating contents therein, in a conventional oven, or in a microwave oven, or other heating device.

FIGS. 42 and 43 are three-dimensional views depicting a value-added packaged food embodiment of the MPFSA wherein the upper surface of food-supporting surface 14 is comprised of a material known to strongly absorb microwaves, such as a susceptor material 226 (shown in black), or Radiation Absorbing Material (RAM), or a metallized cardboard susceptor material, which facilitate rapid heating when the food item(s) is resting on the material and heated in a microwave oven, or combination convection and microwave oven, or other heating device. It is noted that alternatively, the MPFSA can also have susceptor material covering one or more other surfaces of the apparatus or portions thereof, including but not limited to, the interior or exterior surfaces of clamshell tops or removable lids, such as those shown in, or ones similar to, the illustrations of, and explanations pertaining to, FIGS. 40, 41 and 43. The susceptor material can include, but is not limited to, metal particles from one or more of the following families of metals: aluminum, titanium nitride and tin oxide. Preferably the susceptor's conductive layer has a coating, such as a thin plastic, to prevent contact with the food, in which case, the coating consists of material, and is applied in a manner, that are in compliance with FDA requirements. The plastic material can be a modified poly(ethylene terephthalate) suitable for high temperatures (PET materials). In each case, the material from which a susceptor-equipped fold-as-you-eat MPFSA is made, is optimally suited for being heated within a microwave oven, or microwave/convection oven, or other heating device, and can optionally also be comprised of a material optimally suited for refrigeration or freezing purposes. The apparatus material itself can optionally serve as the underlying substrate for the susceptor material. The substrate material can be cardboard, or alternatively, the susceptor can include any or all of the materials employed in the susceptors used to heat microwaveable retail pizza. In FIG. 43, the susceptor equipped tray and a lid portion are shown sealed within a protective wrap. The apparatus can also have one or more surface area comprised of a temperature sensing and temperature indicating material, having a safety-enhancing functionality which indicates to a user how hot the served food-item(s) is In each embodiment of the present invention, the MPFSA facilitates the holding of one or more items of food in the apparatus with one hand, for example, by using one's hand to secure a portion of the food item(s) between a lower surface of the food-retention tab 54 and an upper surface of the food-supporting surface 14, allowing a user to hold a beverage cup, or glass, or can, and/or napkin, or telephone, or writing implement, in the other hand.

The MPFSA also provides a method for increasing food-serving apparatus advertising exposures and decreasing advertising verification procedures, comprising the steps of:

1. acquiring a market penetration of at least one MPFSA type;
2. selling advertising at rates relative to:
3. the market penetration,
4. the area of advertising coverage on at least one surface of the MPFSA, and
5. relative to MPFSA's measurable increased discernible-content exposure times, its close-proximity exposure times and its increases in content exposure times during hand-to-mouth movements;
6. eliminating the need for a substantial number of personnel to regularly monitor a large number of venues to verify and ensure actual use of food-serving apparatus and advertising appearing thereon,
   by means of a written agreement between a MPFSA supplier and business entity operating at least one venue which receives MPFSA, wherein the agreement stipulates:
   the number of units ordered per at least one specified venue during a specified time period;
   that units of the MPFSA received by the venue(s) are to be employed exclusively for serving at least one specified food-item.

A second, related method comprises the step of a MPFSA supplier verifying that the number of MPFSA:

1. received by the at least one specified venue,
2. during the specified time period,
3. for exclusively serving the at least one specified food-item, is proportionate to a number of food-serving apparatus units typically needed for such venue(s) during such a period, for such food-item(s).

A third, related method comprising the step of a MPFSA having discernible content pertaining to at least one retail product is provided which, wherein in addition to the food-item(s), is also sold at the same venue location by the business entity. Similarly, a method comprising the step of a MPFSA having discernible content pertaining to at least one service is possible which, in addition to the food-item (s), is also provided at the same venue location by the business entity.

In a final embodiment, the MPFSA also provides a method for substantially increasing the profit margins generated by food-serving apparatus, comprising the steps of:

1. acquiring a market penetration of at least one MPFSA type;
2. selling advertising at rates relative to:
3. the market penetration,
4. the area of advertising coverage on at least one surface of the MPFSA, and
5. relative to MPFSA's measurable increased discernible-content exposure times, its close-proximity exposure times and its increases in content exposure times during hand-to-mouth movements;
6. eliminating the need for a substantial number of personnel to regularly monitor a large number of venues to verify and ensure actual use of food-serving apparatus and advertising appearing thereon,
   by means of a written agreement between a MPFSA supplier and business entity operating at least one venue which receives MPFSA, wherein the agreement stipulates:
   the number of units ordered per at least one specified venue during a specified time period;
   that units of the MPFSA received by the venue(s) are to be employed exclusively for serving at least one specified food-item.

A second, related method, comprises the step of a MPFSA having discernible content pertaining to at least one retail product which, in addition to the food-item(s), is also sold at the same venue location by the business entity. A third, related method comprises the step of a MPFSA having discernible content pertaining to at least one service which, in addition to the food-item(s), is also provided at the same venue location by the business entity.

Although the present invention has been described in connection with the preferred form of practicing it, those of ordinary skill in the art will understand that many modifications can be made thereto within the scope of the claims that follow. Accordingly, it is not intended that the scope of the invention in any way be limited by the above description, but instead be determined by reference to the above description and the claims that follow.

The invention claimed is:

1. A multi-purpose handheld food-serving apparatus, providing repeatable fold-as-you-eat bending and unbending functionality, substantially sized and shaped to that of the size and shape of at least one food-item intended to be served thereon, comprising:

a food-supporting member consisting of a material sized to serve at least one food-item without altering the normal appearance of the food, and having sufficient rigidity when held at one end to support said food-item (s), including when said apparatus is in a substantially horizontal orientation and following at least one bending and unbending cycle;

said food-supporting member having at least one bendable food-retaining portion integrally formed adjacent thereto which extends upward, relative to a food-supporting surface of said member, in a manner which increases the rigidity of the food-supporting member, and said portion(s) is sized, having sufficient rigidity, to facilitate the retention of said food-item(s) on the food-supporting member, and at least one of said portions has an upper edge adjoining a discernible-content displaying tab sized to extend over and cover an upper surface portion of served food-item(s) as said apparatus is held by a user, and the combination of said discernible-content displaying tab and said at least one of said portions comprising at least one flexible material different from that of the rest of the apparatus and being attached adjacent to an end of said apparatus; and said food-supporting member having at least one re-bendable cross-section extending across a width of the member to predispose bending and unbending of the member at said bendable cross-section(s); and at least one of said food-retaining portion(s) having at least one re-bendable reduced-cross-section located tangent to an end of said re-bendable cross-section(s) to predispose bending and unbending of said portion(s) at said reduced-cross-section(s), whereby i. discernible-content of said tab is brought into a user's field of view as the user is about to eat, and as the user is eating, one or more items of food supported on said handheld food-serving apparatus, and ii. a simultaneous bending of a said member re-bendable cross-section(s) and at least one adjacent said portion re-bendable reduced-cross-section causes at least one segment of the apparatus to be bent away from said food-item(s) to fully expose a portion of the food for eating.

2. The handheld food-serving apparatus of claim 1 wherein said apparatus is comprised ofamaterial sufficient in said rigidity to facilitate a rapid user reshaping of a user-bent apparatus, to a substantially unbent previous condition, to provide for a quick setting down of the apparatus in a resting position, as desired.

3. The handheld food-serving apparatus of claim 1 wherein said apparatus is comprised of material sufficient in said rigidity to facilitate a rapid user-reshaping of a user-unbent apparatus, to a previous bent condition, which provides for a quick resumption of the eating of the food-item(s) served on the apparatus.

4. The handheld food-serving apparatus of claim 1 wherein said apparatus is further comprised of a plurality of material, wherein said material is from any one or more of a group consisting of: materials suitable for use in a dishwasher, materials which readily tolerate repeated washings, materials which readily tolerate repeated bending, materials suitable for vacuum forming, materials suitable for plastic-injection molding, flexible plastic materials, materials commonly used for food-serving apparatus, materials suitable for use in a microwave oven, materials suitable for use in a heating device, materials suitable for storage in a refrigeration device, biodegradable materials, and recycled materials.

* * * * *